US010094166B2

(12) United States Patent
Reiner et al.

(10) Patent No.: US 10,094,166 B2
(45) **Date of Patent: *Oct. 9, 2018**

(54) RETRACTABLE BARRIER SYSTEM

(71) Applicant: Glide Rite Corporation, Van Nuys, CA (US)

(72) Inventors: Andrew Eric Reiner, Woodland Hills, CA (US); Thomas James Rose, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/083,757

(22) Filed: Mar. 29, 2016

(65) Prior Publication Data

US 2017/0284153 A1 Oct. 5, 2017

(51) Int. Cl.

| | |
|---|---|
| ***A47G 5/00*** | (2006.01) |
| ***E06B 9/17*** | (2006.01) |
| ***A47H 1/13*** | (2006.01) |
| ***E06B 9/78*** | (2006.01) |
| ***E06B 9/60*** | (2006.01) |
| *E06B 9/00* | (2006.01) |

(52) U.S. Cl.

CPC ..... *E06B 9/17* (2013.01); *A47H 1/13* (2013.01); *E06B 9/17007* (2013.01); *E06B 9/60* (2013.01); *E06B 9/78* (2013.01); *E06B 2009/002* (2013.01)

(58) Field of Classification Search

CPC .. E06B 2009/002; E06B 11/02; E06B 11/023; E06B 11/026; E06B 9/17; E06B 9/17007; E06B 9/60; E06B 9/78; A47H 1/13

USPC ..... 160/290.1

See application file for complete search history.

(56) References Cited

U.S. PATENT DOCUMENTS

| | | | | | |
|---|---|---|---|---|---|
| 2,859,944 | A * | 11/1958 | Cisney | E06B 11/021 | 160/328 |
| 4,016,921 | A * | 4/1977 | Ericksen | E06B 11/021 | 160/328 |
| 5,170,829 | A | 12/1992 | Duncan et al. | | |
| 5,275,220 | A * | 1/1994 | Siegal | E04B 2/7416 | 160/24 |
| 5,636,679 | A | 6/1997 | Miller et al. | | |
| 5,690,317 | A * | 11/1997 | Sandsborg | E06B 9/08 | 160/300 |
| 5,704,592 | A * | 1/1998 | White | E01F 13/022 | 160/135 |
| 6,056,038 | A | 5/2000 | Foster et al. | | |
| 6,360,984 | B1 * | 3/2002 | England | B65H 16/02 | 242/557 |
| 6,375,165 | B1 * | 4/2002 | Sherratt | E06B 9/0692 | 256/1 |
| 6,435,250 | B1 | 8/2002 | Pichik et al. | | |

(Continued)

FOREIGN PATENT DOCUMENTS

| | | | | |
|---|---|---|---|---|
| CA | 2233760 | A1 * | 11/1999 | E01F 13/02 |
| WO | WO-9713049 | A1 * | 4/1997 | A01K 1/0017 |
| WO | WO9713049 | A1 | 4/1997 | |

*Primary Examiner* — Katherine W Mitchell
*Assistant Examiner* — Johnnie A. Shablack

(57) ABSTRACT

A retractable barrier system and method for inhibiting access to designated private and public areas both indoors and outdoor, including retail and warehouse aisles and the like, includes a flexible screen retractable and extensible from a rotatable rod coupled to a mounting member, the mounting member having an attachment mechanism for coupling with a receiving member such as storage rack assembly support post or bracket or the like.

12 Claims, 19 Drawing Sheets

(56) References Cited

U.S. PATENT DOCUMENTS 6,499,254 B2 * 12/2002 Rossman ..... A01K 1/0017 160/210
6,536,502 B2 * 3/2003 Britto ..... E06B 9/08 160/23.1
6,575,435 B1 6/2003 Kotzen
6,591,890 B1 * 7/2003 Grubb ..... E06B 9/80 160/291
6,688,480 B1 2/2004 Denny
6,733,204 B1 * 5/2004 Paniccia ..... E01F 7/06 160/238
6,779,537 B1 * 8/2004 Miller ..... A01M 31/00 135/117
6,807,999 B1 10/2004 Bowen et al.
6,854,505 B2 * 2/2005 Grubb ..... E06B 9/80 160/291
7,082,981 B2 * 8/2006 Perez, Jr. ..... A01K 1/035 160/24
7,178,792 B2 * 2/2007 Monahan ..... E06B 9/08 160/10
7,207,370 B2 4/2007 Snyder et al.
7,219,709 B1 5/2007 Williams
7,237,591 B2 7/2007 Snyder et al.
7,337,822 B2 3/2008 Snyder et al.
7,370,685 B2 * 5/2008 Moriya ..... E06B 9/54 160/120
7,377,490 B1 * 5/2008 Khosravian ..... E01F 13/028 119/416
7,384,017 B1 6/2008 Burke et al.
7,487,816 B2 * 2/2009 Moriya ..... E06B 9/54 160/23.1
8,087,443 B2 1/2012 Snyder et al.
8,191,604 B2 * 6/2012 Wang ..... E06B 9/0692 160/23.1
8,327,565 B2 * 12/2012 Boltz ..... G09F 15/0025 256/24
8,490,668 B2 7/2013 Snyder et al.
8,584,401 B2 * 11/2013 Planck ..... E06B 11/02 404/6
8,826,963 B2 * 9/2014 Wiegel ..... B65G 69/003 160/23.1
8,863,811 B2 * 10/2014 Yates ..... E06B 9/0623 160/136
8,881,787 B2 * 11/2014 Wang ..... E06B 9/60 160/24
8,887,441 B2 * 11/2014 Lundh ..... E05B 43/00 160/296
8,925,614 B2 * 1/2015 Okachi ..... E06B 9/54 160/31
8,991,470 B1 3/2015 Pacheco
9,598,896 B1 * 3/2017 Pichik ..... E06B 9/08
2005/0098770 A1 5/2005 Schell
2005/0211389 A1 * 9/2005 Snyder ..... E01F 13/028 160/23.1
2006/0076544 A1 4/2006 Kurple
2006/0113519 A1 6/2006 Prismall
2006/0151123 A1 7/2006 Chandler et al.
2006/0191644 A1 * 8/2006 Snyder ..... E01F 13/028 160/23.1
2006/0213626 A1 * 9/2006 Snyder ..... E01F 13/028 160/120
2007/0228349 A1 * 10/2007 Smith ..... E01F 13/028 256/12.5
2008/0006375 A1 * 1/2008 Meadows ..... E06B 9/52 160/371
2008/0121354 A1 * 5/2008 Cheng ..... E06B 9/80 160/290.1
2009/0008042 A1 * 1/2009 Snyder ..... E01F 13/028 160/264
2014/0196371 A1 * 7/2014 Lundh ..... E05B 17/10 49/13
2015/0190001 A1 7/2015 Floersch et al.
2016/0245381 A1 * 8/2016 Birkert ..... F16H 25/20

* cited by examiner

RETRACTABLE BARRIER SYSTEM

CROSS-REFERENCE TO RELATED APPLICATIONS

None.

TECHNICAL FIELD

This invention relates generally to removable gates for temporarily inhibiting access to designated areas, and more particularly to a portable and retractable barrier system that may be quickly and easily installed and removed, and engaged and disengaged, as necessary to temporarily prevent access to such designated areas, including, retail and warehouse aisles, checkout aisles, and other private and public spaces both indoors and outdoors.

BACKGROUND ART

Removable gates, particularly child and pet safety gates, are well known in the art for use in preventing access to residential areas considered unsafe or undesirable for children or pets. Conventional gates characteristically comprise a plurality of cooperating gate sections that are generally horizontally extensible and retractable within narrow entryways such as between doorjambs, opposed walls, and balustrade uprights, and the like. These safety gates are commonly provided on ends thereof with compressible buffer stops comprising elastomeric material or other suitable spring mechanisms, which when compressed and then released, function to effectively set the corresponding gate or gate sections against displacement between the respective opposed fixed extremes defined by the entryways. Additional safety laches and the like have been used to further secure the relative positions of the corresponding gate sections and prevent inadvertent or undesired disengagement of the same following installation.

To remove the aforementioned safety gates after installation, the safety laches, if any, must first be disabled or released whereupon the buffer stops may be compressed (generally by applying lateral pressure to the same) to temporarily relieve applied tension on the opposed fixed extremes of the corresponding entryways. The gate sections may then be sufficiently retracted for the gate or gate system to be removed. Removable child and pet safety gates of the type described above are commonly used in residential environments to prevent access to kitchens, stairways, garages, and other living and working areas.

Removable gates have similarly been used in retail and warehouse environments to temporarily prevent access to designated service and work areas including shopping aisles, check-out aisles and the like, as may be defined, for example, by shelving and storage racks such as pallet rack systems and assemblies. As those skilled in the art will recognize, conventional pallet rack systems typically comprise a plurality of support posts for receiving corresponding horizontal connecting lengths and vertically spaced horizontal rack beams. Each support post generally comprises a single piece of metal having an outwardly faced or facing post section or margin, parallel side post sections or margins, and an opposed terminal end section or margin defining a substantially square or rectangular post cross section. The outwardly facing post sections and parallel post sections are each typically provided with multiple rows of vertically spaced pairs of keyhole slots or other suitable stamped apertures. The slots in each pair are often angularly related to one another to allow a better fit for components being attached to the pallet rack, including the above referenced rack beams.

In the conventional pallet rack systems described above, the support posts are secured together in any suitable relation by the referenced horizontal connecting lengths as well as a series of corresponding truss legs or the like. Characteristically, the connecting lengths are affixed to opposing terminal post end sections and/or parallel side post sections by threading and securing one or more fasteners through corresponding apertures such as the referenced keyhole slots. A plurality of vertically spaced horizontal rack beams are affixed to opposing parallel side post sections (and often the corresponding outwardly faced post sections as well) by similarly threading and securing one or more fasteners through the corresponding post section apertures. Each horizontal rack beam is typically comprised of sheet metal having a ledge for receiving and supporting a wooden plank or other suitable shelving material such as sheet metal decking or the like, which in turn receives and supports product for storage and display.

In these retail and warehouse applications, the entryways and "aisles" defined by opposing post end sections of corresponding storage racks are typically substantially wider than residential entryways, and thus generally unsuitable for residential type compression gates of the type described above. Accordion or "scissor-style" gates have therefore been employed which are capable of spanning these extended distances.

As those skilled in the art will recognize, accordion gates typically comprise a plurality of interconnected and moveable accordion elements or members that cooperate together to permit the respective gates to be unitarily extensible and retractable, as limited by the number and length of the corresponding elements. Accordion gates are typically mounted and substantially permanently affixed in the aforementioned entryways at their trailing gate ends to receiving outwardly facing post sections by threading one or more bolts through corresponding receiving keyholes or apertures stamped in the respective components. When not required for use, the gates are secured to the receiving posts in substantially retracted storage positions, limited by the number and width of extensible accordion elements, using chains, flexible cord, or other suitable retention devices. When it is subsequently desirable to block and inhibit access to a corresponding entryway and/or aisle section, the retention device is removed or disabled, whereupon the gate may be extended and secured at its leading end to a corresponding opposing and receiving outwardly facing post section in the same or similar manner using one or more bolts threaded through receiving keyholes or apertures.

The aforementioned accordion gates, while effective and commonly used, by design comprise multiple movable accordion elements that increase the size, weight, and complexity of the corresponding gates, which in turn, correspondingly increases the associated costs of manufacture, shipping, maintenance and repair of the same. Those skilled in the art will further recognize that the above referenced installation common to such accordion gates, namely securing the same at trailing edges in retracted storage positions with chains and flexible cord, may result in decreased visibility of products or signage stored or displayed in proximity to the gate, particularly at or near end caps or shelving units. Still further, such accordion gates may extend or otherwise protrude, even in retracted, stored and secured positions, undesirable distances into corresponding entryways or aisles creating potential obstructions for shopping carts and machinery that may result in damage to the respective gates. Lastly, such gates, by design, are generally unsuitable for pre-printed signage, such as may be useful for example, to notify persons of the presence of the gate (whether in the extended or storage position) or advise that the corresponding aisle or area has been temporarily closed. Accordingly, retail and warehouse managers may be required to incur additional time and expense to obtain, post, and change such signage on or in proximity to such gates.

To address the above issues, there have been disclosed a variety of extensible, collapsible and retractable gates provided for use in retail and warehouse environments as well as residential applications. See, for example, Canadian Patent No. CA2233760 issued to Secure-Plast, Inc.; U.S. Pat. No. 5,170,829 issued to Duncan et al.; U.S. Pat. No. 5,636,679 issued to Miller et al.; U.S. Pat. No. 6,056,038 issued to Foster et al.; U.S. Pat. No. 6,435,250 issued to Pichik et al.; U.S. Pat. No. 6,575,435 issued to Tracy A. Kotzen; U.S. Pat. No. 6,688,480 issued to David S. Denny; U.S. Pat. No. 6,807,999 issued to Bowen et al.; U.S. Pat. No. 7,207,370 issued to Snyder et al.; U.S. Pat. No. 7,219,709 issued to John Williams; U.S. Pat. No. 7,237,591 issued to Snyder et al.; U.S. Pat. No. 7,337,822 issued to Snyder et al.; U.S. Pat. No. 7,384,017 issued to Burke et al.; U.S. Pat. No. 8,087,443 issued to Snyder et al.; U.S. Pat. No. 8,490,668 issued to Snyder et al.; U.S. Pat. No. 8,991,470 issued to Steven A. Pacheco; U.S. Patent Publication No. 2015190001 filed by Floersch et al.; U.S. Patent Publication No. 20050098770 filed by Ronald Allan Schell; U.S. Patent Publication No. 20050211389 filed by Snyder et al et al.; U.S. Patent Publication No. 20060076544 filed by William M. Kurple; U.S. Patent Publication No. 20060113519 filed by Ian James Prismall; U.S. Patent Publication No. 20060151123 filed by Chandler et al.; U.S. Patent Publication No. 20060191644 filed by Snyder et al.; U.S. Patent Publication No. 20060213626 filed by Snyder et al.; U.S. Patent Publication No. 20090008042 filed by Snyder et al.; and International Patent Application WO9713049 filed by Edwin Hardy.

The aforementioned extensible gates and gate systems address some of the issues raised above. However, they still generally require fixed storage positions and may therefore extend or protrude into corresponding entryways and aisles during such storage thus creating potential obstructions to shopping carts and machinery and reducing customer or employee visibility of displayed product and signage. Many such gate systems also require self-standing implementations wherein internal support posts are provided as part of the gate system thus raising concerns that the system may be removed or otherwise become inadvertently uninstalled.

Still further, as those skilled in the art will appreciate, in conventional pallet rack systems and assemblies of the type described above, shelving units, and more particularly, horizontal rack beams and corresponding fasteners, affixed to opposing outwardly facing post sections, may occupy all or part of an aperture row pair designated for affixing the respective trailing and leading gate ends. In such case, the gate ends will be required to be affixed to different aperture rows (above or below the occupied rows) possibly requiring gate placement at different heights at the respective leading and trailing gate ends and resulting in misalignment of the gate once extended. Still further, horizontal rack beams and the corresponding connecting bolts disposed in intervening aperture rows (within the span of respective top and bottom gate ends) as well as product stored on the received shelves, often extend or protrude from the receiving posts beyond the outwardly facing post sections into the defined entryways and aisles to obstruct and sometimes preclude attachment of the respective gate ends entirely. In such case, the referenced extensible gates and gate systems may not be used.

Accordingly, there is a need for an improved barrier system that overcomes the disadvantages of the prior art. Such a system should be aesthetically pleasing and capable of implementation in retail and warehouse environments and the like, including private and public shopping, storage, service, and checkout areas and aisles, whether indoors or outdoors. Such a system should further be capable of implementation with conventional storage systems such as pallet rack systems and assemblies and/or brackets or the like, including implementation with proper alignment when one or more designated receiving post apertures or aperture rows are unavailable or occupied such as by horizontal rack beams or bolts. Still further, the system should be capable of implementation when stored product or one or more horizontal rack beams and/or corresponding connecting fasteners disposed in intervening aperture rows within the span of respective top and bottom gate ends (leading and/or trailing) extend or protrude from the receiving posts beyond the outwardly facing post sections into the defined entryways. Yet still further, such a system should be amenable to pre-printed signage and be quickly and easily installed and removed and engaged and disengaged to safely and effectively block and inhibit access to the above designated areas without reducing or obstructing product visibility or causing obstructions to shopping carts or other machinery, users or personnel during use or storage.

DISCLOSURE OF INVENTION

It is a principle object of the present invention to provide a portable and removable barrier system for use in inhibiting access to designated areas including private and public retail and warehouse aisles and the like, both indoor and outdoor, which system may be quickly and easily installed and removed and engaged and disengaged.

It is a further object of the present invention to provide a portable and removable barrier system for use in inhibiting access to such designated areas, which system is aesthetically pleasing and capable of implementation with conventional storage systems such as pallet racking systems or assemblies or other suitable receiving posts or brackets.

It is still further an object of the present invention to provide a portable and removable barrier system for use in inhibiting access to such retail and warehouse aisles and the like, which system may be installed with proper alignment in conventional pallet racking systems or other suitable receiving posts or brackets wherein one or more corresponding receiving post apertures are occupied, blocked, or otherwise unavailable.

It is a further an object of the present invention to provide a portable and removable barrier system for use in inhibiting access to designated areas such as retail and warehouse aisles and the like, wherein the barrier system comprises a flexible screen retractable about a rotatable rod, and wherein a leading end of the flexible screen includes an attachment mechanism to provide bridged attachment over intervening objects at or near the leading end to permit the barrier system to be installed with proper alignment when one or more receiving apertures at the leading end of the screen are occupied or otherwise unavailable.

It is still further an object of the present invention to provide a portable and removable barrier system for use in inhibiting access to designated areas including retail and warehouse aisles and the like, wherein the barrier system comprises a flexible screen retractable about a rotatable rod, and wherein the rod is further coupled to at least one standoff portion having an attachment mechanism for coupling the same with a corresponding receiving bracket or post aperture in a conventional pallet rack system or assembly, to provide bridged attachment over intervening objects at or near the standoff portion, and/or permit the barrier system to be installed with proper alignment when one or more receiving apertures at the trailing end of the screen are occupied or otherwise unavailable.

It is still further an object to the present invention to provide such a portable and removable barrier system for use in inhibiting access to designated areas such as retail and warehouse aisles and the like, further comprising a winding mechanism coupled to the rotatable rod for applying rotational tension on the rod, which mechanism may still further comprise a spring mechanism including but not limited to a torsion spring.

In carrying out these and other objects, features and advantages of the present invention, there is provided a retractable barrier system for blocking and inhibiting access to designated areas including private and public retail and warehouse aisles and the like, both indoor and outdoor. The barrier system comprises a rotatable rod, a flexible and retractable screen, and a winding mechanism. The rotatable rod may be coupled by an attachment mechanism to a receiving bracket or pallet post aperture. The flexible screen includes a trailing edge that may be affixed to the rotatable rod, and a leading edge having an attachment mechanism for similarly coupling the screen with a corresponding leading edge receiving member such as a bracket or pallet post aperture. The winding mechanism, preferably, but not necessarily comprises a spring mechanism coupled at one end to a fixed shaft and coupled at an opposing end to the rotatable rod. The winding mechanism functions to apply rotational tension against the rod for retractably receiving and extending the flexible screen between a closed position wherein the flexible screen is recoiled and an open position wherein the screen is fully extended to span and block an entryway, aisle or other designated area.

In a preferred embodiment, a leading end of the flexible screen includes an attachment mechanism that provides bridged attachment over intervening objects at the leading edge of the screen and further permits the barrier system to be installed with proper alignment when one or more such receiving apertures at the leading edge of the screen or at or near the rotatable rod are occupied or otherwise unavailable. The attachment mechanism may also be adjustable.

In a further preferred embodiment, a standoff portion may be coupled to the rotatable rod to provide bridged attachment over intervening objects at or near the rotatable rod and standoff portion, and/or permit the barrier system to be installed with proper alignment when one aperture of a corresponding receiving aperture pair is occupied or otherwise unavailable. In yet a further preferred embodiment, the standoff portion is provided with an adjustment mechanism such as a laterally or horizontally extendible and retractable hook to provide more secure coupling to the referenced receiving bracket or post aperture at or near the rotatable rod.

In further carrying out the above objects, features and advantages of the present invention, there is also provided a method for blocking and inhibiting access to private and public retail and warehouse aisles and the like, both indoor and outdoor, comprising providing a rotatable rod coupled to a standoff portion, a flexible and retractable screen, and a winding mechanism. The method further comprises applying rotational tension to the rotatable rod, and coupling the standoff portion to a first receiving member such as a bracket or pallet post aperture whereby the standoff portion will provide bridging over intervening objects at or near the rotatable rod, and coupling a leading edge of the flexible screen to a second receiving member such as bracket or pallet post aperture to extend and secure the screen.

BEST MODE FOR CARRYING OUT THE INVENTION

Figure 1:
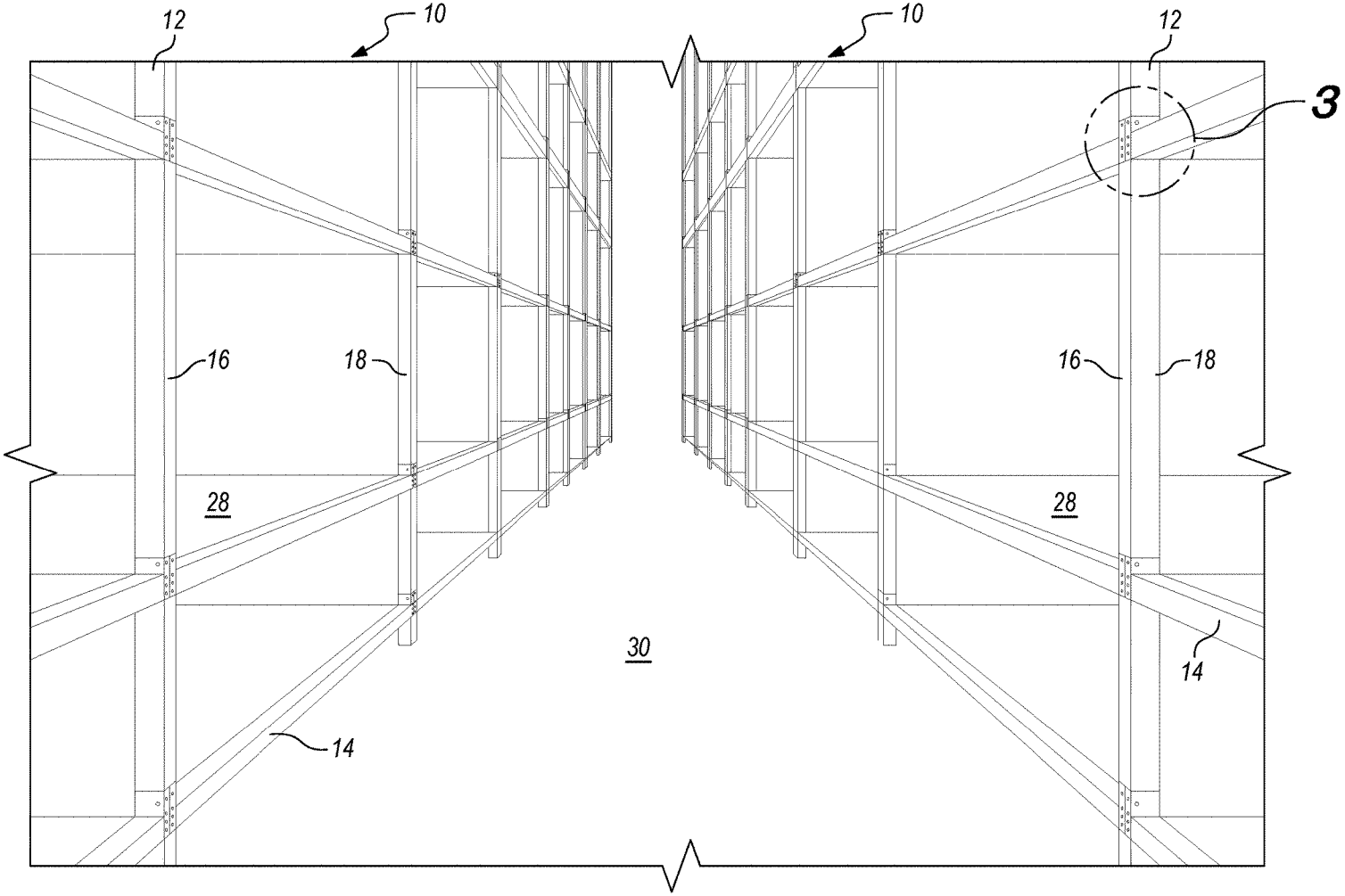
FIG. 1 PRIOR ART
FIG. 1 is a perspective diagram of a conventional pallet rack system as implemented in a retail or warehouse environment and shown defining a corresponding storage and/or shopping aisle.
Figure 2:
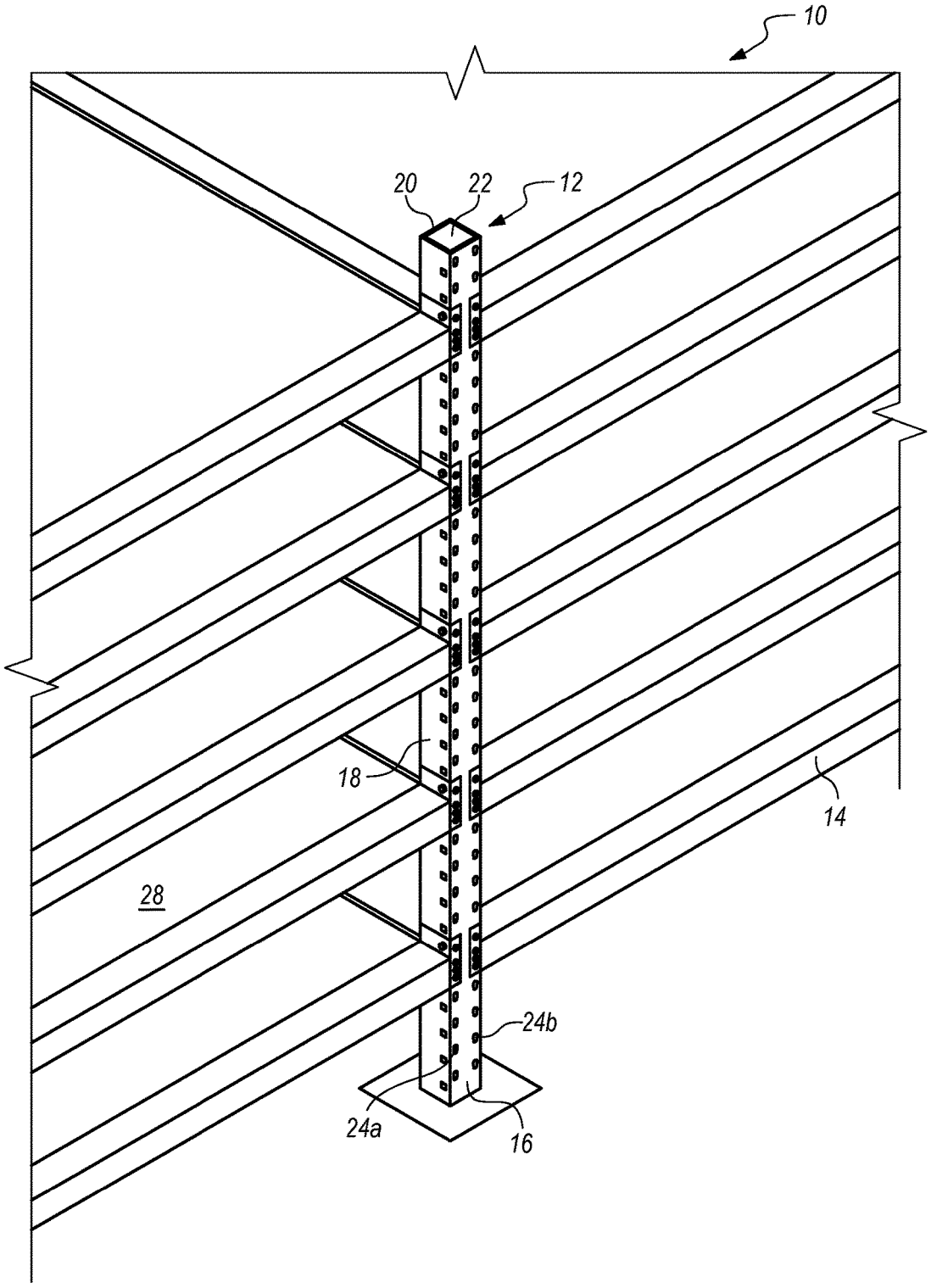
FIG. 2 PRIOR ART
FIG. 2 is an exploded perspective diagram of the pallet rack system of FIG. 1.
Figure 3:
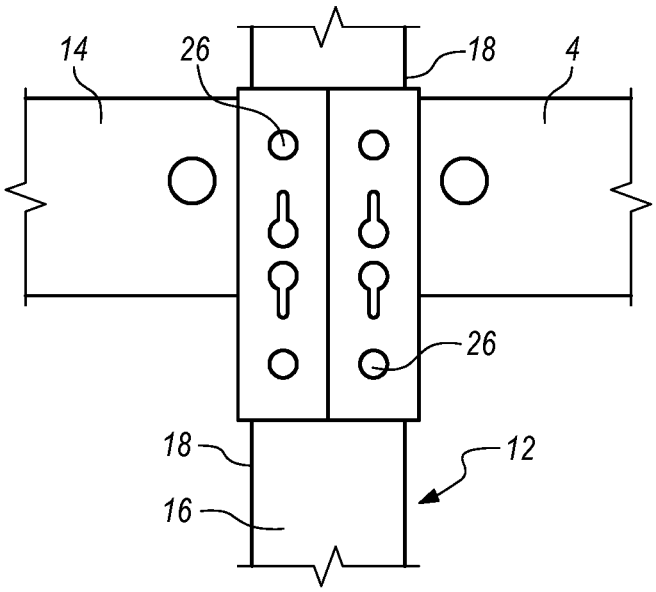
FIG. 3 PRIOR ART
FIG. 3 is a front elevation view showing the detail of the area designated by reference numeral 3 in FIG. 1.

With reference to FIGS. 1-2 of the drawings, there is provided perspective diagrams of a conventional pallet rack shelving system or assembly 10 suitable for use with the present invention to block and inhibit access to private and public designated areas both indoors and outdoors including retail and warehouse aisles and the like. As those skilled in the art will recognize, assembly 10 includes a plurality of support posts 12 for receiving corresponding horizontal connecting lengths (not shown) and vertically spaced horizontal rack beams 14. Each support post 12 generally comprises a single piece of metal having an outwardly faced post section or margin 16, parallel side post sections or margins 18, and an opposed terminal end section or margin 20 defining a substantially square or rectangular post cross section 22.

As shown more fully in the exploded perspective view of FIG. 2, the outwardly facing post sections 16 and parallel post sections 18 are each typically provided with at least a row of vertically spaced stamped apertures such as keyhole slots 24 and preferably, but not necessarily, two rows thereof defining horizontally spaced aperture or slot pairs 24*a* and 24*b*. The slots 24 in each slot pair (24*a*, 24*b*) may be angularly related to one another to allow a better fit for components being attached to the rack 10, including the above referenced rack beams 14. The support posts 12 are secured together in any suitable relation by the horizontal connecting lengths, as referenced above, as well as a series of corresponding truss legs or the like (not shown).

Characteristically, the connecting lengths are affixed to opposing terminal post end sections 20 and/or parallel side post sections 18 by threading and securing one or more fasteners such as bolts 26 (including but not limited to hex bolts, carriage bolts, flange bolts, and the like) through the corresponding apertures 24. A plurality of vertically spaced horizontal rack beams 14 are affixed to opposing parallel side post sections 18 (and often the corresponding outwardly faced post sections 16 as well thus occupying multiple keyholes 24 in at least one vertical row) by similarly threading and securing one or more bolts 26 through the corresponding post section apertures 24. Each horizontal rack beam 14 is typically comprised of sheet metal having a ledge or lip (not shown) for receiving and supporting a wooden plank or other suitable shelving material 28 such as sheet metal decking or the like, which in turn receives and supports product for storage and display. The placement of opposing pallet rack assemblies 10 in such retail and warehouse environments defines corresponding and generally parallel aisles 30 in relation thereto as shown in FIG. 1.

Figure 4:
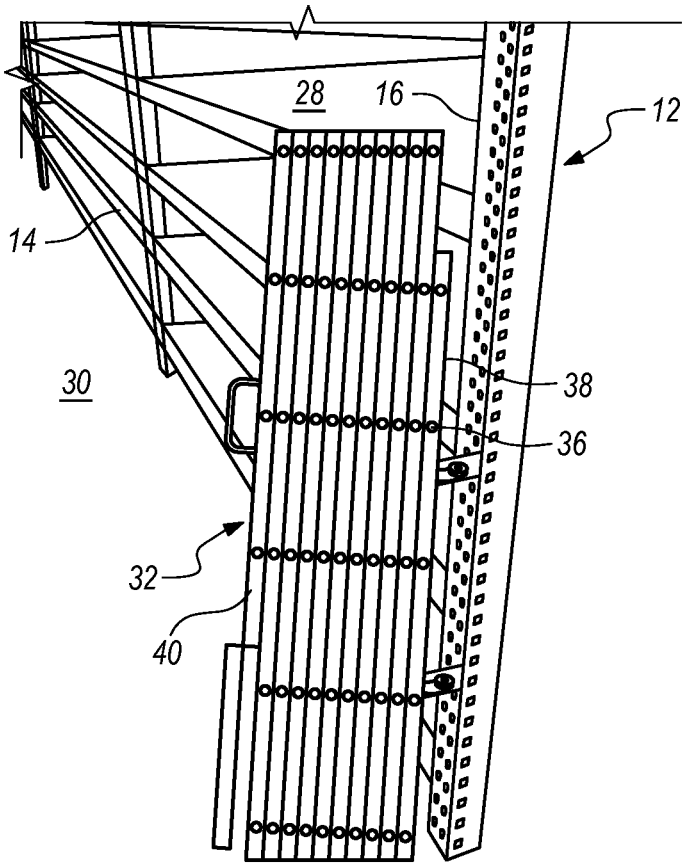
FIG. 4 PRIOR ART
FIG. 4 is a perspective diagram of a prior art accordion gate shown affixed to the pallet rack system of FIG. 1 in a retracted storage position as implemented in a retail or warehouse environment.
Figure 5:
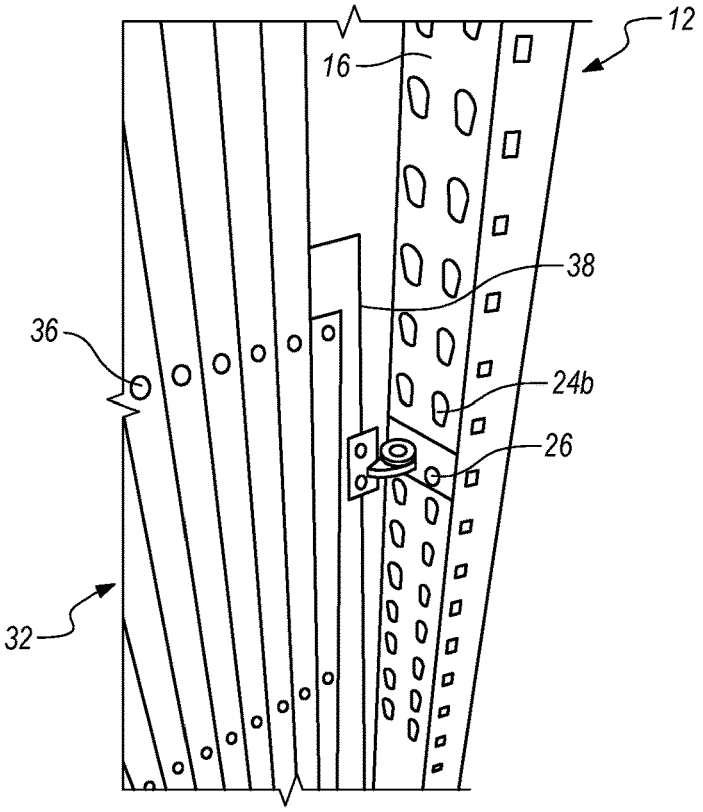
FIG. 5 PRIOR ART
FIG. 5 is an exploded perspective diagram of the accordion gate of FIG. 4.
Figure 6:
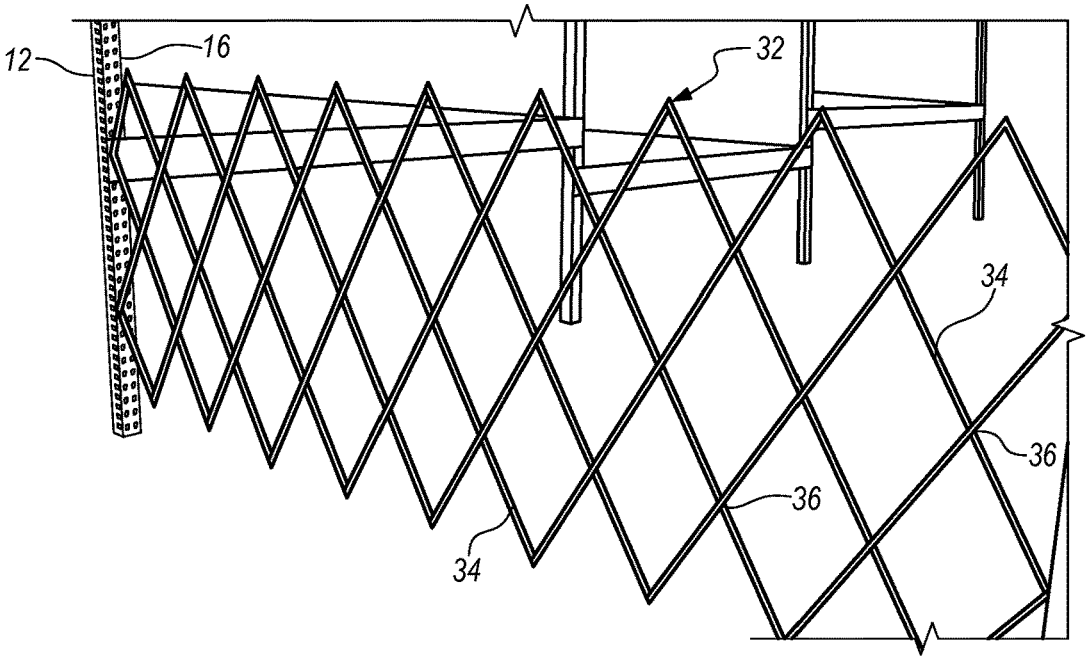
FIG. 6 PRIOR ART
FIG. 6 is a perspective diagram of FIGS. 4-5 shown in an extended position as implemented in a retail or warehouse environment to prevent access to a corresponding entryway or aisle.
Figure 7:
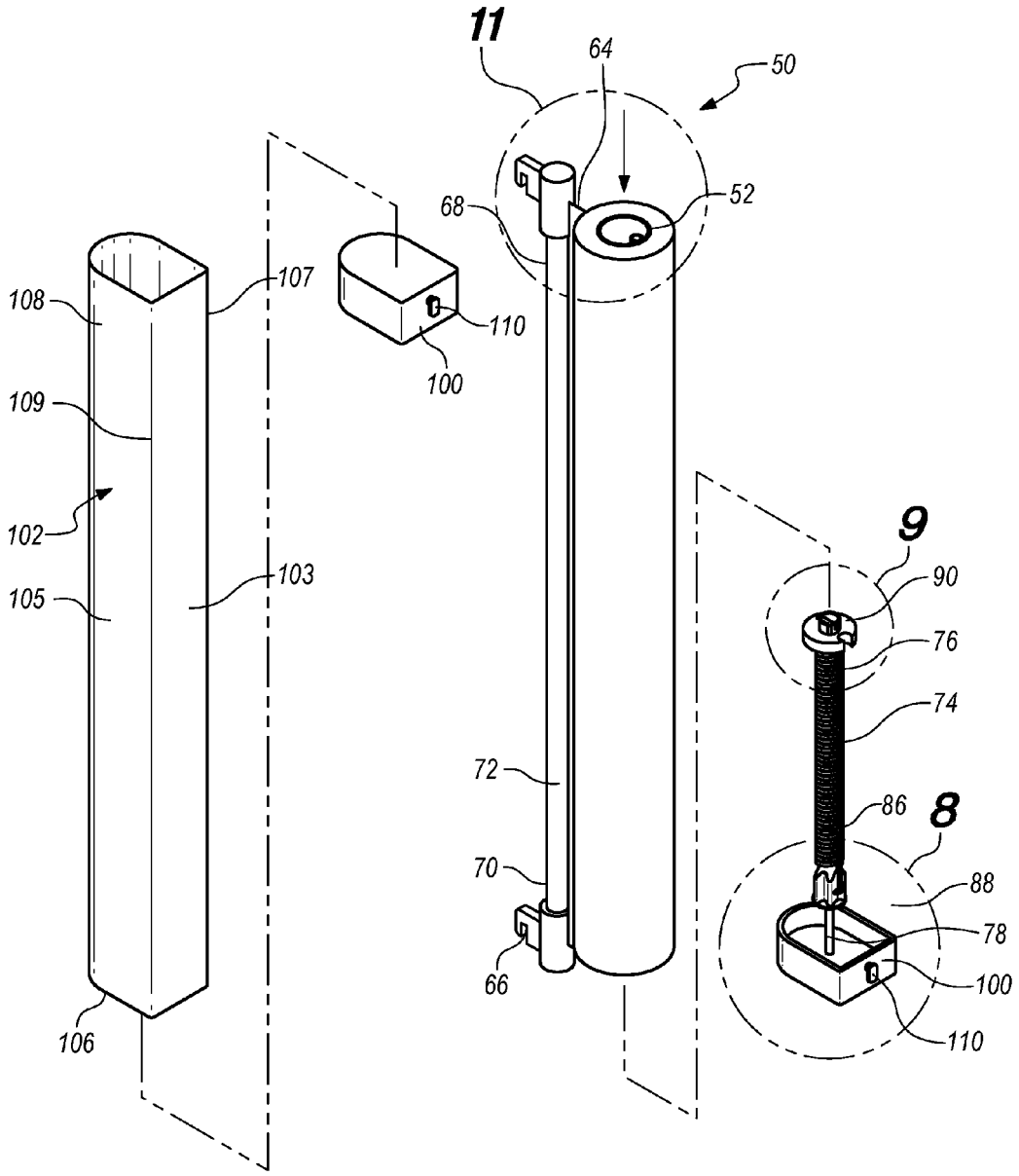
FIG. 7 is an exploded perspective diagram of the general components of the retractable barrier system in a first preferred embodiment of the present invention.
Figure 8:
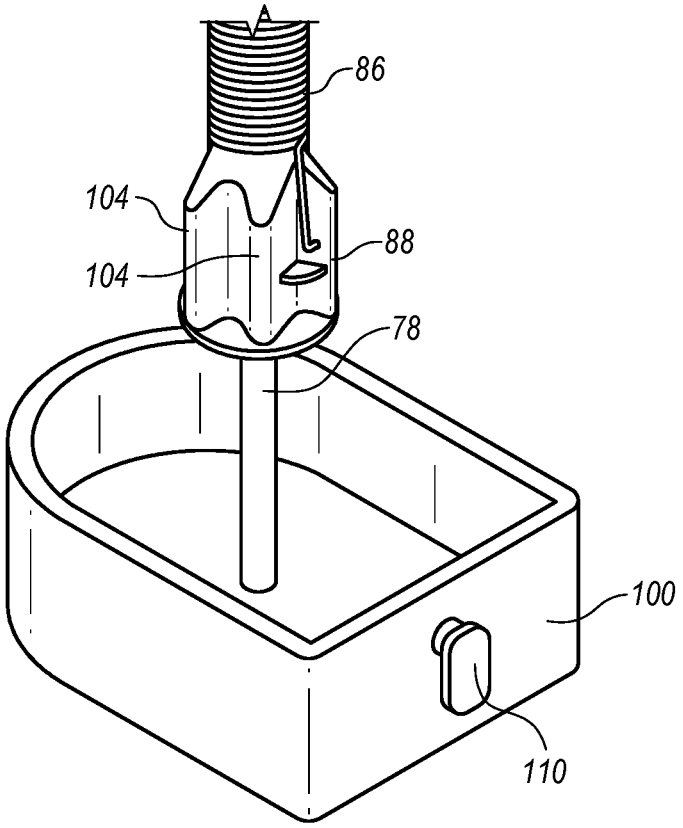
FIGS. 8-13 are detailed perspective diagrams of respective components of the retractable barrier of FIG. 7.
Figure 9:
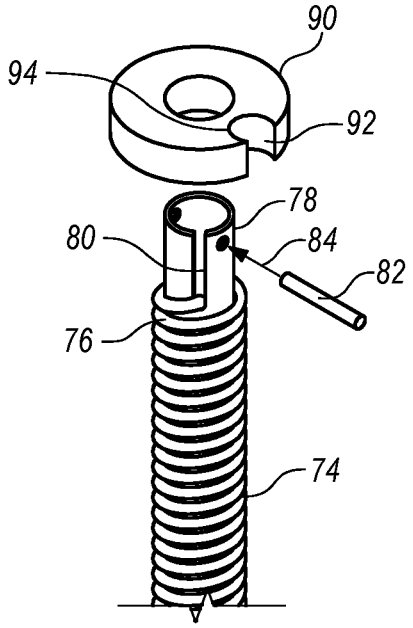

Turning now to FIGS. 4-6 of the drawings, there is shown perspective diagrams of a prior art accordion or "scissor-style" retractable gate 32 as implemented in an aisle of opposing conventional pallet rack assemblies 10. As discussed above, accordion gate 32 comprises a plurality of accordion elements or members 34 interconnected and movable about pivot points 36. Accordion members 34 cooperate together to permit gate 32 to be unitarily extensible and retractable, as limited only by the number and length of such elements 34. As shown, accordion gate 32 is typically mounted in an aisle 30 at its trailing gate end 38 to receiving outwardly facing post sections 16 by threading one or more fasteners such as bolts 26 through corresponding receiving keyholes or apertures 24 stamped in the respective components. When not required for use, gate 32 is typically, but not necessarily, secured to receiving posts 12 in a substantially (but no completely) retracted storage position, limited by the number and width of extensible accordion elements 34, using chains, flexible cord, or other suitable retention devices (not shown). When it is subsequently desirable to block and inhibit access to a corresponding entryway or aisle 30, the retention device is removed or disabled, whereupon the gate 32 may be extended and secured at its leading end 40 to a corresponding opposing and receiving outwardly facing post section 16 of a receiving post 12 in the same or similar manner using one or more fasteners such as bolts 26 threaded through receiving keyholes or apertures 24.

As readily seen, the multiple movable accordion elements 34 increase the size, weight, and complexity of the corresponding gate 32, which in turn, correspondingly increases the associated costs of manufacture, shipping, maintenance and repair of the same. As also indicated above, the foregoing installation common to such accordion gates, namely securing the same at trailing edges 38 in retracted storage positions with chains and flexible cord, may result in decreased visibility of products or signage stored or displayed in proximity to the gate, particularly at or near pallet end caps or shelving units. Still further, accordion gate 32 may extend or otherwise protrude, even in a stored and secured position, an undesirable distance into corresponding aisles 30 thus creating potential obstructions for shopping carts and machinery that may result in damage to the same and/or gate 32.

Turning now to FIGS. 7-13 of the drawings, there is provided exploded perspective diagrams and detailed views of the basic components of a first preferred embodiment of the retractable and flexible barrier system 50 of the present invention. As discussed above, system 50 is provided for use with a conventional pallet rack system or assembly 10 or posts or brackets (not shown) having the same or similar functionality thereof including receiving apertures 24 and preferably, but not necessarily aperture rows defining aperture row pairs 24*a* and 24*b*. Barrier system 50 is thus provided for use in inhibiting access to private and public designated areas both indoors and outdoors such as the above referenced retail and warehouse aisles 30 and the like.

System 50 in a first preferred embodiment, thus includes at least a rotatable elongate mounting rod 52 that may be directly or indirectly affixed to a trailing edge 56 of a flexible screen 54 and a corresponding receiving member such as an outward facing post section 16 or side post section 18 of a conventional pallet post 12 or other suitable bracket through corresponding receiving apertures such as keyhole slots 24. Mounting rod 52 may comprise any suitable material including, but not limited to, extruded aluminum. The referenced trailing edge 56 of flexible screen 54 may be affixed to mounting rod 52 in any suitable manner. In the preferred embodiment shown, mounting rod 52 is provided with an elongate annular notch 58 that spans a sufficient vertical length of mounting rod 52 such that a concave portion 60 thereof may receive a mounting tube 62 affixed to the trailing edge of flexible screen 54. Mounting tube 62 similarly spans a sufficient vertical length of flexible screen 54 and may be affixed thereto by any suitable means including adhesive. As shown, mounting tube 62 may be inserted into the concave notch portion 60 of mounting rod 52 to secure flexible screen 54 to mounting rod 52. Screen 54 may thereafter be wound about mounting rod 52 as will be discussed in further detail below. Again, mounting tube 62 may comprise any suitable material and may be affixed to the trailing edge 56 of flexible screen 54 in any suitable manner including, but not limited to, mechanical attachment, adhesive, or melting/fusing the components together. In the latter case, mounting tube 52 may be comprised of plastic or other material capable of being adhered to flexible screen 54 by applying heat and/or pressure, or the like.

Flexible screen 54 may comprise or include any suitable material or fiber including cloth, canvas, plastic, wire, paper, netting, and the like, or any combination thereof that may be readily and easily retracted about mounting rod 52 when the barrier 50 is disengaged, and extended therefrom when the barrier 50 is intended to be engaged as necessary to span an entryway or other designated private or public area 30 whether indoor or outdoor. Flexible screen 54, by nature of its unitary, flexible, and retractable design, is also amenable to having pre-printed wording or signage placed thereon including of any suitable nature and provided for display at a plurality of extension or recoil positions. For example, such wording or signage may be placed at or near a leading edge 64 for intended display when screen 54 is partially extended, at or near trailing end 56 for intended display when screen 54 is fully extended, or anywhere therein between. Such wording or signage may also be printed on opposing sides of the screen 54 and positioned thereon at any suitable location to prevent ink seepage or message interference, depending on the translucency and type of barrier material being used.

Still referring to FIGS. 7-13, flexible screen 54 is further provided with an attachment mechanism 66 operative to couple a leading edge 64 thereof to an outward facing post section 16 or side post section 18 of one or more pallet posts 12 or other suitable brackets or bracket sections. Attachment mechanism 66 may comprise one or more hook brackets that may be affixed at top and/or bottom ends 68 and 70 of the leading edge 64 of screen 54 or any other suitable position there between. For example, hook brackets 66 may be affixed near the center or midpoint between the respective top and bottom ends 68 and 70 to provide quicker and easier connection and disconnection by a user. Hook brackets 66 may also be, but are not required to be, rotationally movable about a vertical axis thereof to permit easy connection with any suitable outward facing post section 16 or side post section 18 of a corresponding pallet post 12 or bracket depending upon the installation. As shown, hook brackets 66 may be affixed to respective ends of an attachment rod or pull member 72. Pull member 72 is further affixed to leading edge 64 of flexible screen 54 by any suitable means, including adhesive. It is understood, however, that pull member 72 is provided in a preferred embodiment only, and may be eliminated without departing from the spirit or scope of the invention herein described.

A winding mechanism such as a conventional spring or, more preferably, but not necessarily, a torsion spring 74, is further provided as shown in the referenced FIGS. 7-13. As those skilled in the art will recognize, torsion springs are typically helical springs that function to exert a torque or rotary force. When twisted, a torsion spring thus exerts a force, actually torque, in the opposite direction that is proportional to the amount (angle) it is twisted. Characteristically, the respective ends of a torsion spring are attached to other components, and when those components rotate around the center of the spring, the spring exerts a counterforce in attempt to push the components back to their original position. While the name implies otherwise, so-called torsion springs are actually subjected to bending stress rather than torsional stress. In operation, such springs function to store and subsequently release substantial angular energy (mechanical energy) or statically hold a mechanism in place by deflecting the legs about a body centerline axis.

In the preferred embodiment shown, torsion spring 74 is affixed at a top end 76 thereof to a shaft 78 and more particularly to a shaft slot 80. It is understood, however, that torsion spring 74 may of course be affixed and secured to shaft 78 by any suitable means including, but not limited to, the above-described shaft slot 78. Torsion spring 74 is further affixed at a bottom end 86 thereof to a bottom key or winding key 88. In keeping with the invention and the preferred embodiment shown and described, bottom key 88 freely rotates about the center axis of shaft 78 and functions to wind or "pre-load" torque onto torsion spring 74 prior to insertion into mounting rod (and wound barrier screen 54) as will be described in further detail below. There is also provided a top key 90 positioned at and affixed to the top end 76 of shaft 78. Like bottom key 88, top key 90 freely rotates about shaft 78, and more particularly, about top end 76 of shaft 78. Top key 90 is secured from removal from shaft 78 by roll pin 82 received within corresponding shaft apertures 84. Again, it is understood that any suitable means may be used to secure top key 90 from removal. Notably, top key 90 is not affixed to torsion spring 78. Rather, top key 90 includes an annular notch 92 that functions to guide the assembly (torsion spring 74 and shaft 78) into mounting rod 52. More specifically, concave portion 94 of top key annular notch 92 is received by convex portion 96 of mounting rod annular notch 58, as will be described in further detail below.

Still referring to FIGS. 7-13, the preferred embodiment shown and described includes top and bottom caps 98 and 100, respectively, and a housing 102. Again, the foregoing may comprise any suitable material including plastic, molded one piece aluminum, cast aluminum, extruded aluminum, and the like. In the preferred embodiment shown, top and bottom caps 98 and 100, also called top and bottom base caps, comprise cast aluminum and housing 102 comprises extruded aluminum. Bottom base cap 100 is affixed to shaft 78 in any suitable manner, including, for example by receiving shaft 78 within a receiving notch, aperture, or extension portion 101 affixed to or molded within bottom cap 100 and securing the same with a roll pin (not shown) so that shaft 78 is secured and oriented so it can't move. Once secured, bottom base cap 100 will rotate with shaft 78. Accordingly, once torsion spring 74 (affixed to shaft 78) is preloaded with torque to store mechanical energy, bottom cap 100 must be secured in place to prevent release of such energy. Housing 102 further includes a mounting sidewall 103 which is preferably, but not necessarily, substantially flat and coplanar along both its length and width, and at least a supplemental side wall 105 extending between housing first and second ends 106 and 108, respectively, to define an internal cavity. Housing 102 also includes an elongate vertically disposed opening (not shown) or slot for receiving and extending barrier screen 54 through the housing once assembled. As illustrated, in this preferred embodiment supplemental sidewall 105 is substantially rounded extending contiguously from opposing vertical edges 107 and 109 of mounting sidewall 103 about substantially a ninety-degree radius thereof. It is understood, however, that any suitable configuration and number of additional sidewalls, including no sidewalls, may be utilized without departing from the spirit, scope and functionality of the disclosed invention.

Figure 10:
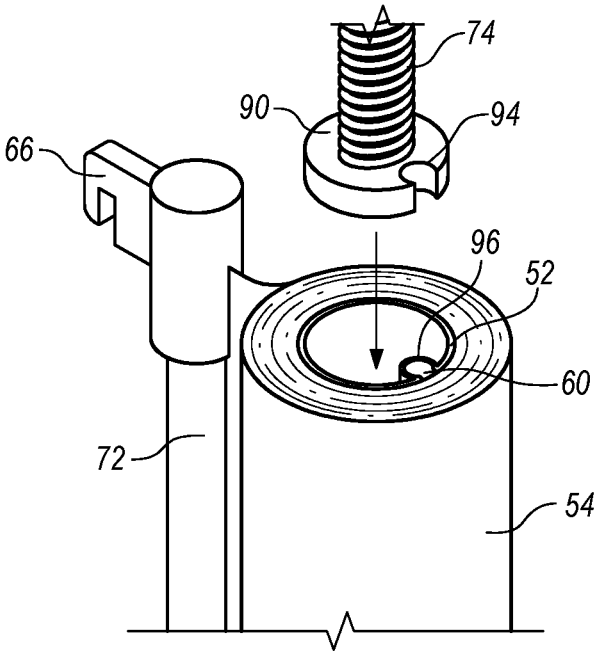
Figure 11:
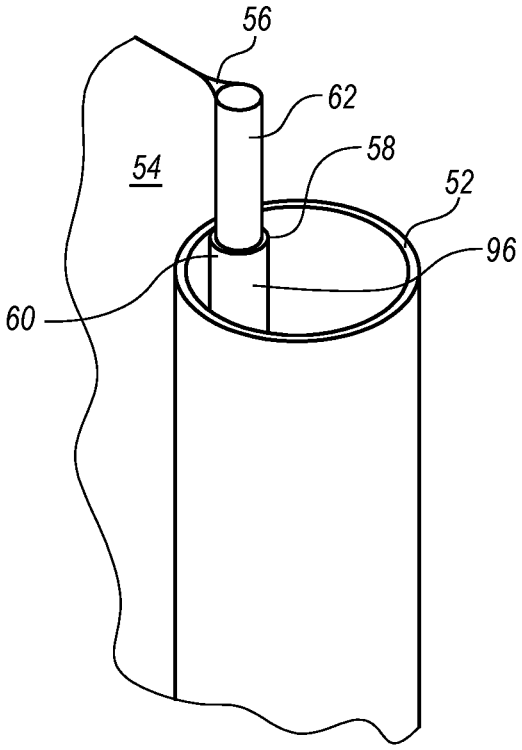
Figure 12:
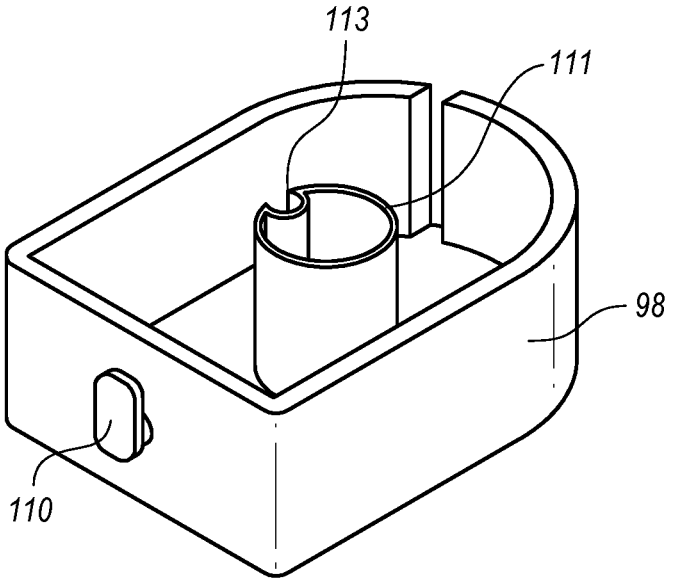
Figure 13:
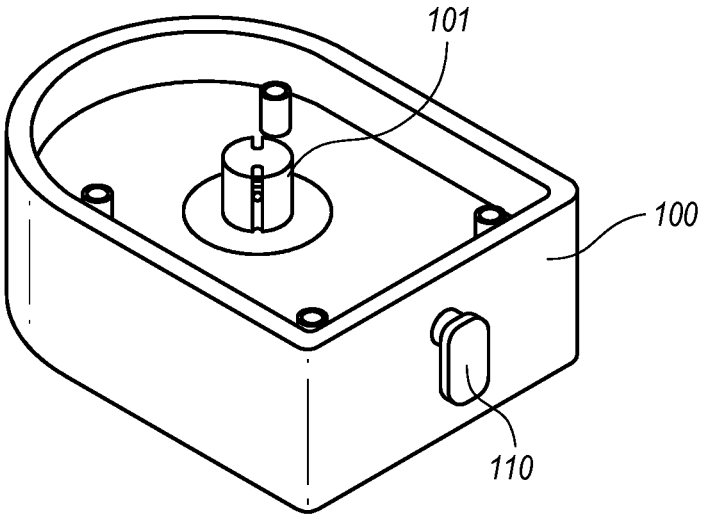
Figure 14:
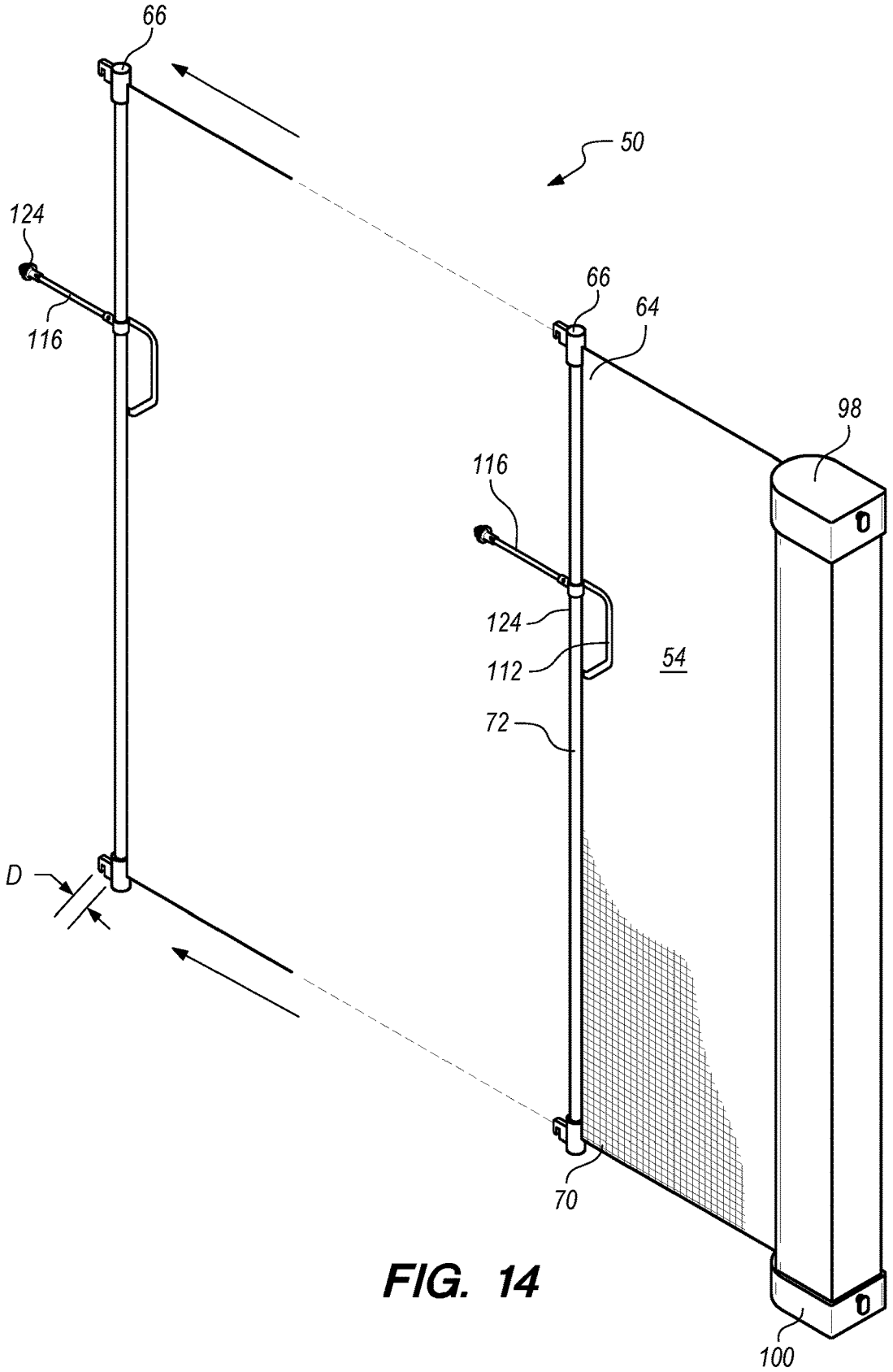
FIG. 14 is a perspective diagram of a second preferred embodiment of the retractable barrier system of the present invention shown disengaged from receiving posts and illustrating the extension path of the corresponding flexible screen.

Referring specifically to FIGS. 10 and 11, the steps for preloading spring 74 with torque and assembling the components of the referenced first preferred embodiment of the invention are described. Spring tension is first applied by rotating or winding base key (winding key) 88. While holding base cap 100 securely in place (as it is affixed to shaft 78), the entire assembly is inserted into mounting rod 52 using top key 90 and more particularly top key notch 94 as a guide for receipt by annular notch 52 and more particularly convex portion 96 thereof. Winding key 88 is thereafter secured in place similarly by mating adjacent ridges 104 with the same convex portion 96 of annular notch 52. Thereafter, bottom cap 100 is secured to bottom end 106 of housing 102 using any suitable fastener or fasteners such as screws or the like. Top cap 98 is similarly secured to top end 108 of housing 102 in like manner. As shown, top cap 98 includes guide 111 having an annular notch 113. Guide 111 functions to freely rotate within top cap 98. Specifically, annular notch 113 receives and mates with corresponding mounting rod notch 60 and even more specifically convex portion 96 thereof. Accordingly, mounting rod 52 may freely rotate within housing 102 about top and bottom caps 98 and 100. More specifically, top end of mounting rod 52 rotates about guide 11 and bottom end of mounting rod 52 rotates about bottom key 88 with preloaded torque applied thereto. In keeping with the invention, top and/or bottom caps 98 and 100 are further provided with lugs 110 or other suitable hook type or other mechanism for attachment to receiving apertures 24 of pallet rack posts 12 or brackets having the same or similar functionality. The assembled flexible barrier system 50 of the first preferred embodiment is shown in FIG. 14. FIG. 14 also includes an adjustable gate attachment mechanism of a second preferred embodiment as described below.

Figure 16:
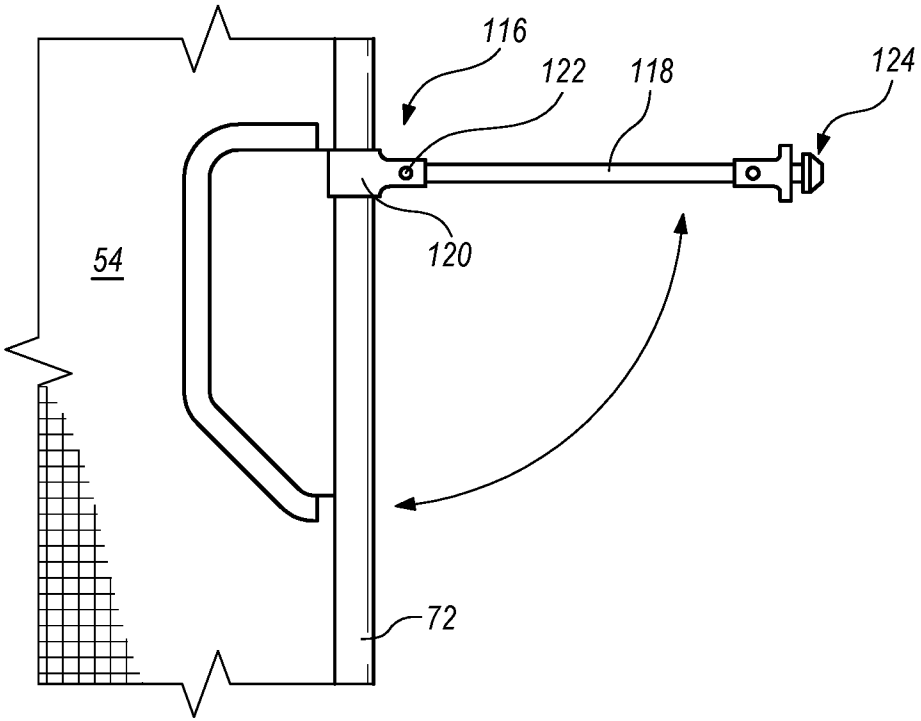
FIGS. 15-16 are partial perspective diagrams of the preferred embodiment of FIG. 13 illustrating in detail the adjustable attachment mechanism provided therein.
Figure 15:
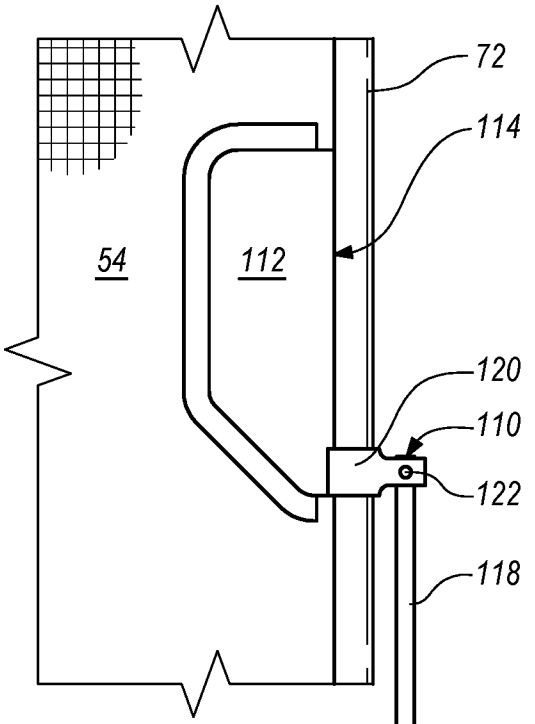

With reference to FIGS. 14-16, in a second preferred embodiment, flexible screen 54 may include a cutout section 112 disposed at any suitable location defining a cutout handle 114 bounded by the flexible screen 54 and if provided, pull member 72. System 50 may further include an adjustable gate attachment member 116. Gate attachment member 116 may comprise any suitable element operative to bridge intervening objects or provide temporary coupling to a suitable receiving aperture of a support post 12 or corresponding bracket having the same or similar functionality. For example, gate attachment member 116 may comprise a tethered or retractable arm or member (for example comprising elastic cord or cable and disposed within and extensible from pull member 72) as well as any rigid or flexible arm or extensible member affixed to the leading edge 64 of flexible screen 54.

Figure 17:
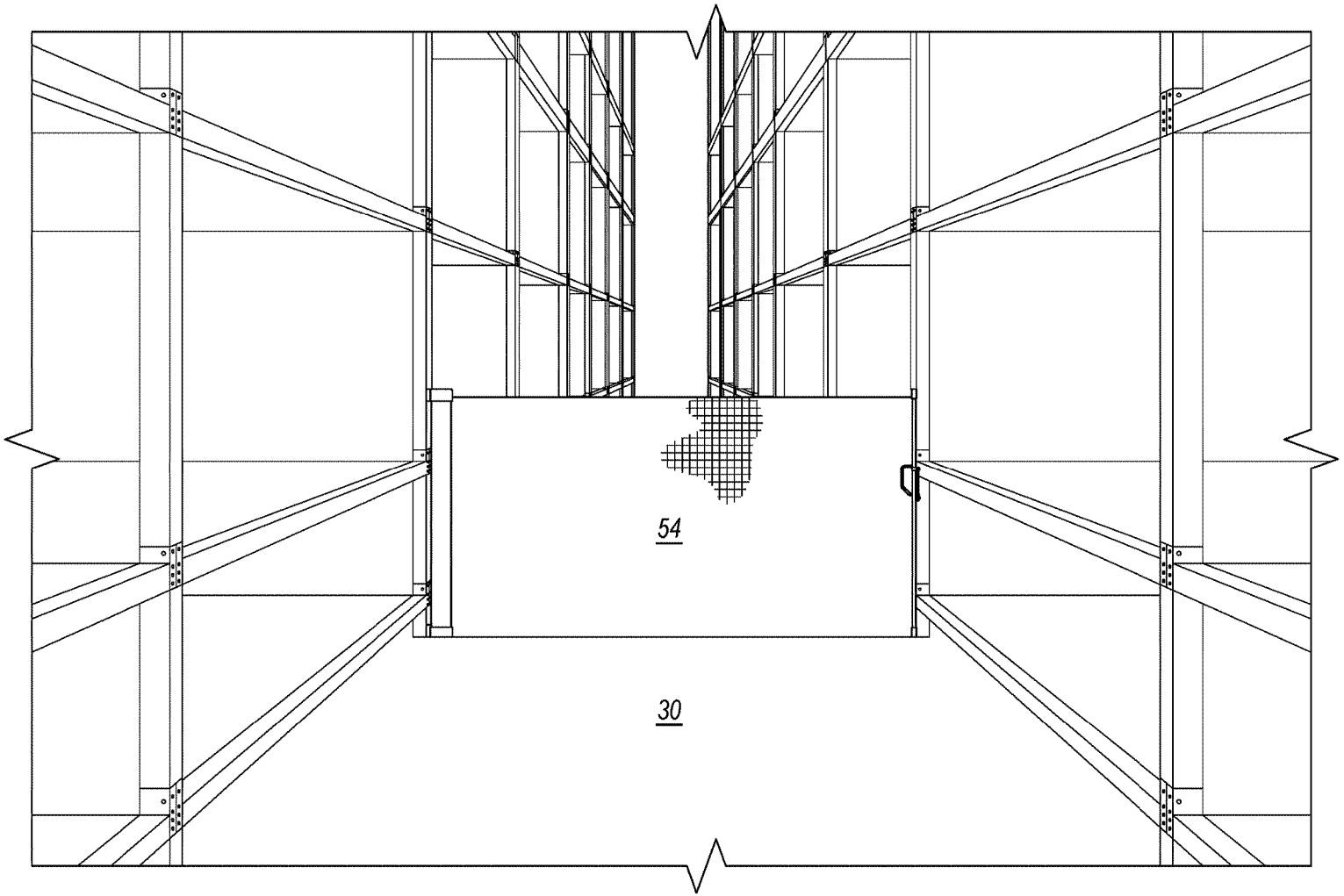
FIG. 17 is a side elevation view of the preferred embodiment of the retractable barrier system of FIGS. 14-16 shown engaged with and extended between opposing receiving posts of a pallet rack assembly.

In the preferred embodiment shown in detail in FIGS. 15-16, gate attachment member 116 comprises a bar arm 118 affixed to pull member 72 by sleeve 120 at any suitable location, including within cutout section 112 or affixed to handle 114. Sleeve 120 (and bar arm 118 affixed thereto) may together function to vertically slide on pull bar 72 to provide adjustable attachment of flexible screen 54 to a receiving post 12 and more particularly, by attachment of bar arm attachment member 124 (itself affixed to bar arm 118) to a corresponding aperture 24 of an outward facing post section 16 or side post section 18. Sleeve 120 may also function to horizontally pivot about pull member 72 to similarly provide adjustable attachment thereof to a corresponding aperture 24 of an outward facing post section 16 or side post section 18. Bar arm 118 may also vertically pivot about pivot point 122 to provide adjustable attachment thereof to a corresponding aperture 24 of an outward facing post section 16 or side post section 18. Bar arm 118, and more particularly bar arm attachment member 124 may therefore be affixed at a multitude of orientations to a receiving member such as an aperture 24 of a receiving post member 12 to accommodate a variety of intervening objects as well as potentially occupied receiving apertures 24. In this preferred embodiment, handle cutout 112 is also disposed slightly above center of the vertical length of pull bar 72 for optimum leverage. In the preferred embodiment shown, bar arm 118 includes a suitable attachment mechanism or member such as hook bracket 124 having a width W that is less than a distance D hook bracket or brackets 66 extend from a vertical reference plane of leading edge 64 of flexible screen 54. Accordingly, bar arm 118 may be rotated downward (or upward) into a disengaged position when not required or desired for use without interfering with or precluding use of hook bracket or brackets 66 as shown, for example, in FIG. 25. It is understood that the foregoing components, along with hook brackets 66, are illustrated as preferred embodiments only and are not intended to and do not limit the scope of the claimed invention as a variety of suitable attachment mechanisms may be used in addition to or in place of the foregoing. The assembled flexible barrier system 50 of this preferred embodiment as installed in a conventional pallet rack system or assembly is shown in FIG. 17.

Figure 18:
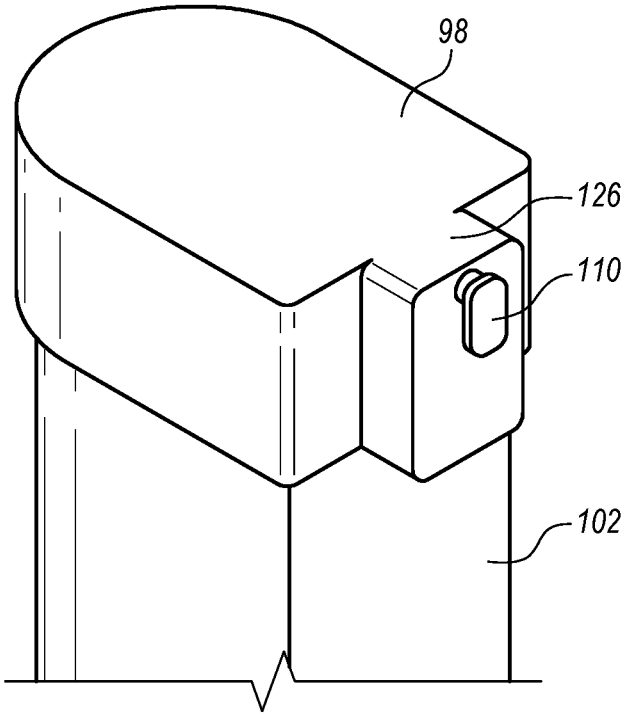
FIG. 18 is a partial perspective diagram of a third preferred embodiment of the present invention providing a set-off portion for bridging intervening objects including one or more rack beams or bolts as may be present in a conventional pallet rack system as implemented in a retail or warehouse environment.
Figure 19:
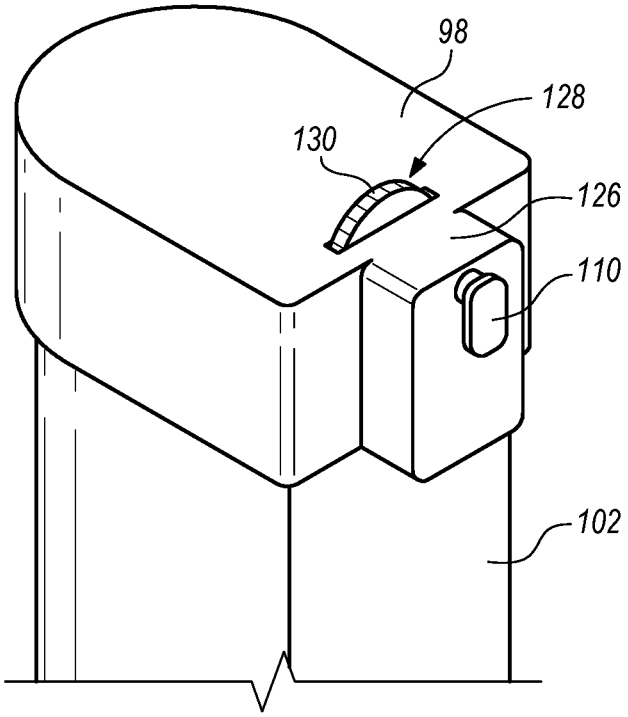
FIG. 19 is a partial perspective diagram of a fourth preferred embodiment of the present invention wherein the set-off portion of FIG. 18 further includes an adjustable attachment mechanism for laterally extending and retracting a corresponding hook member.
Figure 20:
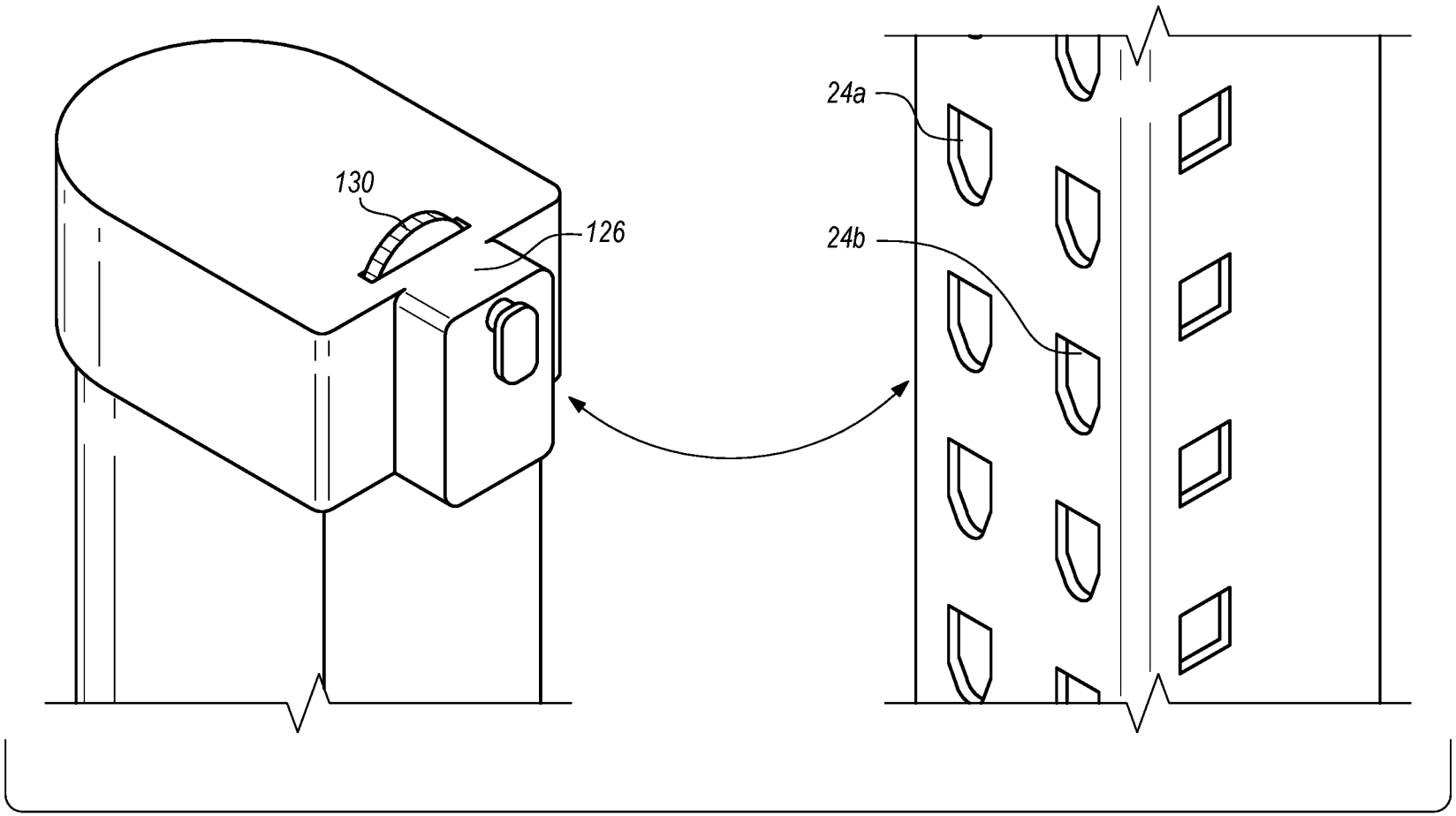
FIGS. 20-22 are partial perspective diagrams of the preferred embodiment of FIG. 19 illustrating in detail the adjustable attachment mechanism therein.
Figure 21:
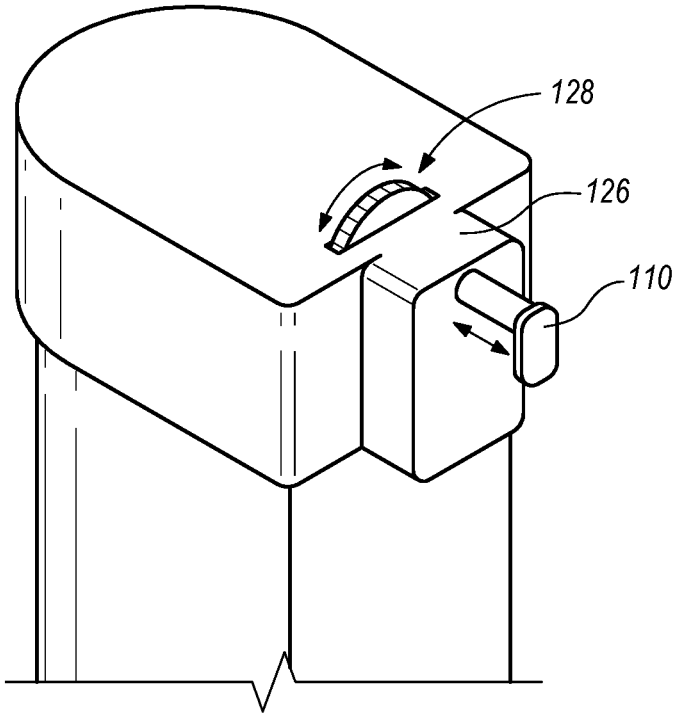
Figure 22:
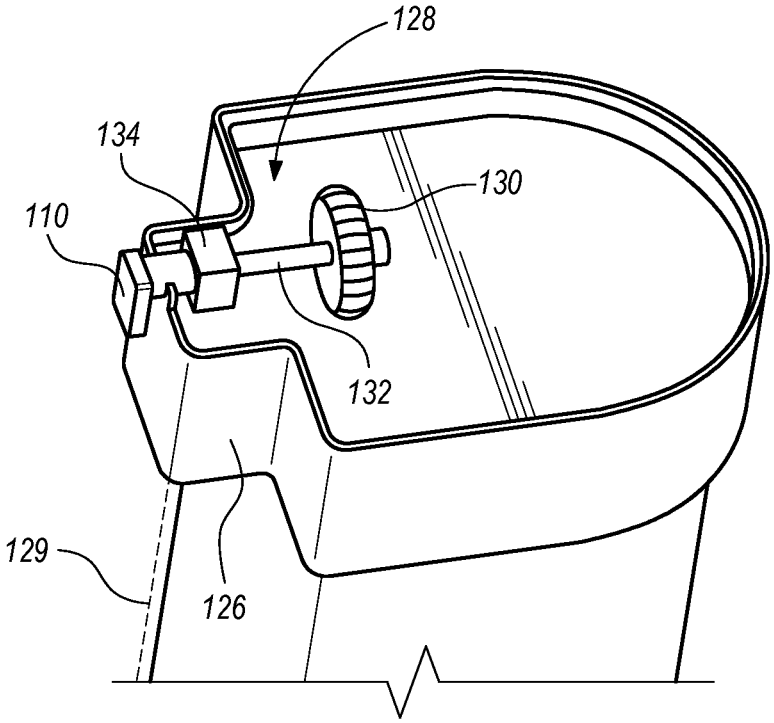

Turning now to FIG. 18, a third preferred embodiment of the flexible barrier system of the present invention is hereinafter described. As shown in FIG. 18, a least one "standoff" portion 126 is directly or indirectly affixed to and extendable from rotatable mounting rod 52 and more preferably, but not necessarily, housing 102 or top or bottom caps 98 or 100, respectively. Stand-off portion 126 further includes a first attachment mechanism such as a lug or hook bracket 110 that may be affixed thereto for coupling barrier system or assembly 50 at its trailing end to a corresponding first receiving member such as a keyhole slot 24 of a an outward facing post section 16 or side post section 18 of a pallet post 12. The foregoing standoff portion 126 and attachment mechanism 110 function independently and collectively to provide "bridging" over intervening objects such as rack beams 14 and/or fasteners 26 or displayed product or machinery or the like which may be positioned on or near racking system 10 and extend into aisle or entryway 30 within the span of the top and bottom ends (e.g. top and bottom ends of housing 102) of barrier system 50 generally and mounting rod 52, specifically. Standoff portion or portions 126 and attachment mechanism or mechanisms 110 further permit attachment to the aforementioned pallet rack assembly posts 12 (including outward facing post sections 16 and/or side post sections 18) in the event one or more keyhole slots 24*a* in a given vertical row are occupied leaving the corresponding horizontal pairs 24*b* available, and vice versa.

Figure 23:
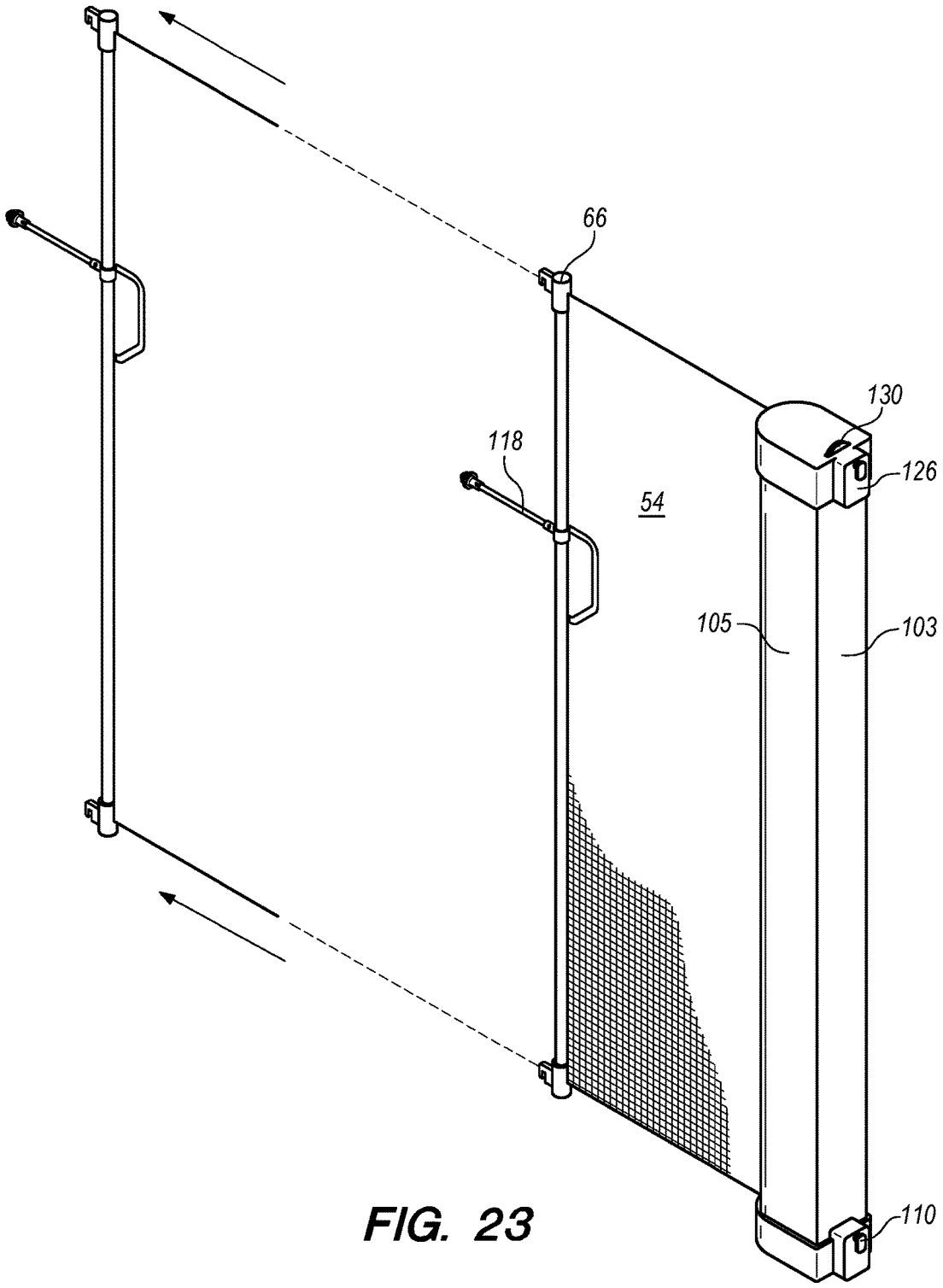
FIG. 23 is a perspective diagram of the preferred embodiment of the retractable barrier system of FIGS. 19-22 shown disengaged from receiving posts and illustrating the extension path of the corresponding flexible screen.

In a further preferred embodiment shown in FIGS. 19-22, the attachment mechanism 110 may include an adjustment mechanism 128 for adjusting a distance the mechanism (e.g. a hook bracket 110) extends therefrom substantially in a horizontal direction such as, for example, from a corresponding vertical plane 129 of the referenced standoff portion or portions 126. As shown, adjustment mechanism may comprise an adjustment wheel 130 affixed to screw pin or threaded shaft 132 that is similarly affixed to hook member 110. Wheel 130 is threaded through anchor 134 which biases and anchors hook member 110. Upon turning wheel 130, screw pin is received within or retracted out of anchor 134 and hook member horizontally extends or retracts accordingly from vertical plane 129. More specifically, shaft 132 is disposed within and extends through a cutout formed in top cap 98 that also functions, in conjunction with anchor 134, to provide anchoring to wheel 130. By rotating wheel 130 in a forward or reverse direction, threaded shaft 132 correspondingly moves hook member through the referenced cutout portion in a substantially horizontal direction to extend or retract hook barrier in relation to a vertical plane of standoff portion 126 thereby providing additional adjustment capability for "hooking" and coupling the respective cap and thus the housing 102 to the referenced receiving posts (namely outward facing post sections 16 and/or side post sections 18). Similar functionality may, of course, be provided at the leading gate end and incorporated with hook brackets 66 and/or pull bar 72. The assembled barrier system 50 of this preferred embodiment is shown in FIG. 23 and further includes the attachment mechanism of the previously discussed preferred embodiment.

Figure 24:
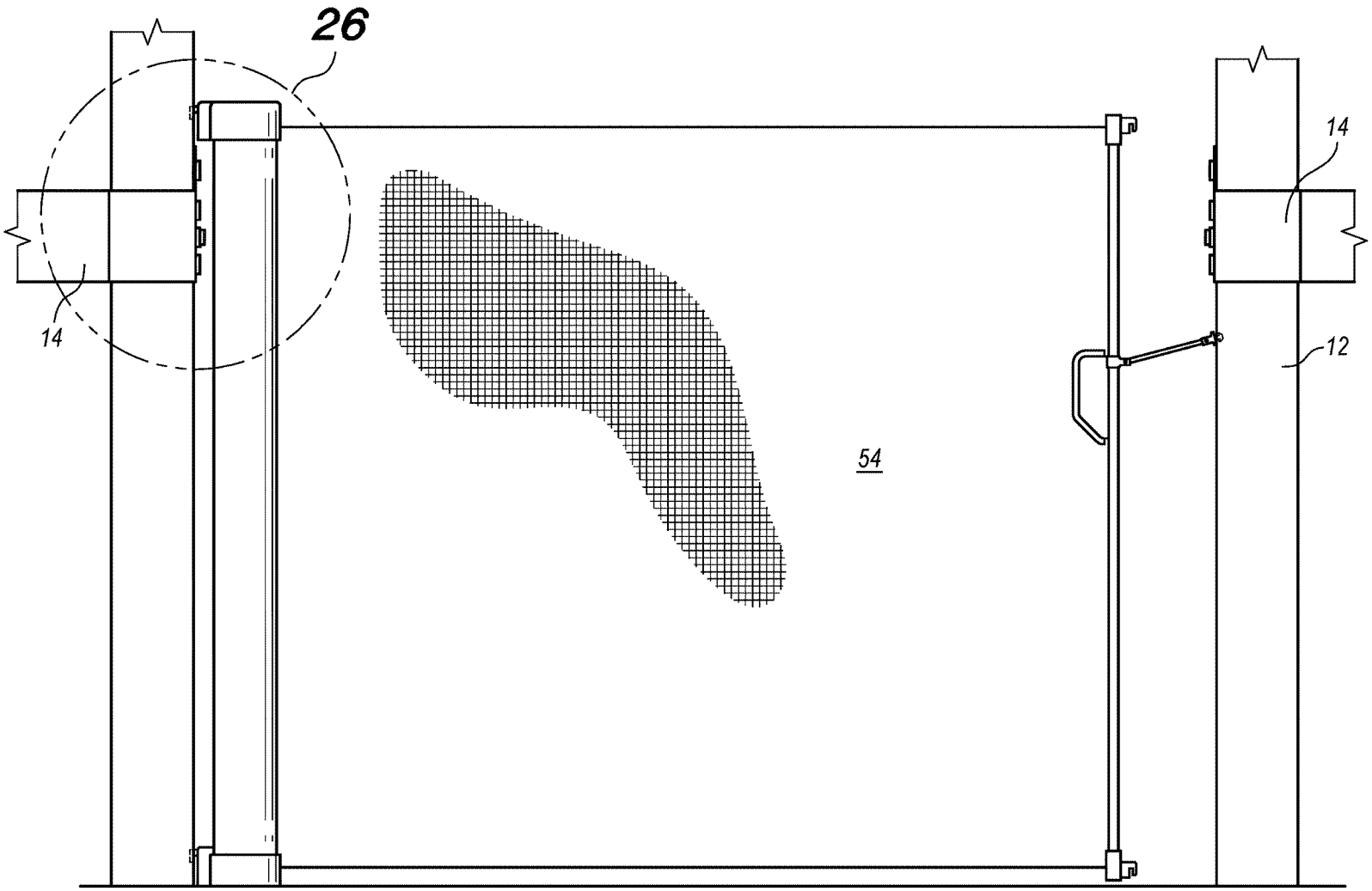
FIGS. 24-26 are partial side elevation view of a preferred embodiment of the retractable barrier system of FIGS. 19-23 shown engaged with a first receiving post of a pallet rack assembly and illustrating in detail the coupling and bridging effect provided by the set-off portion with regard to intervening objects such as installed rack members, shelving units, and fasteners.
Figure 25:
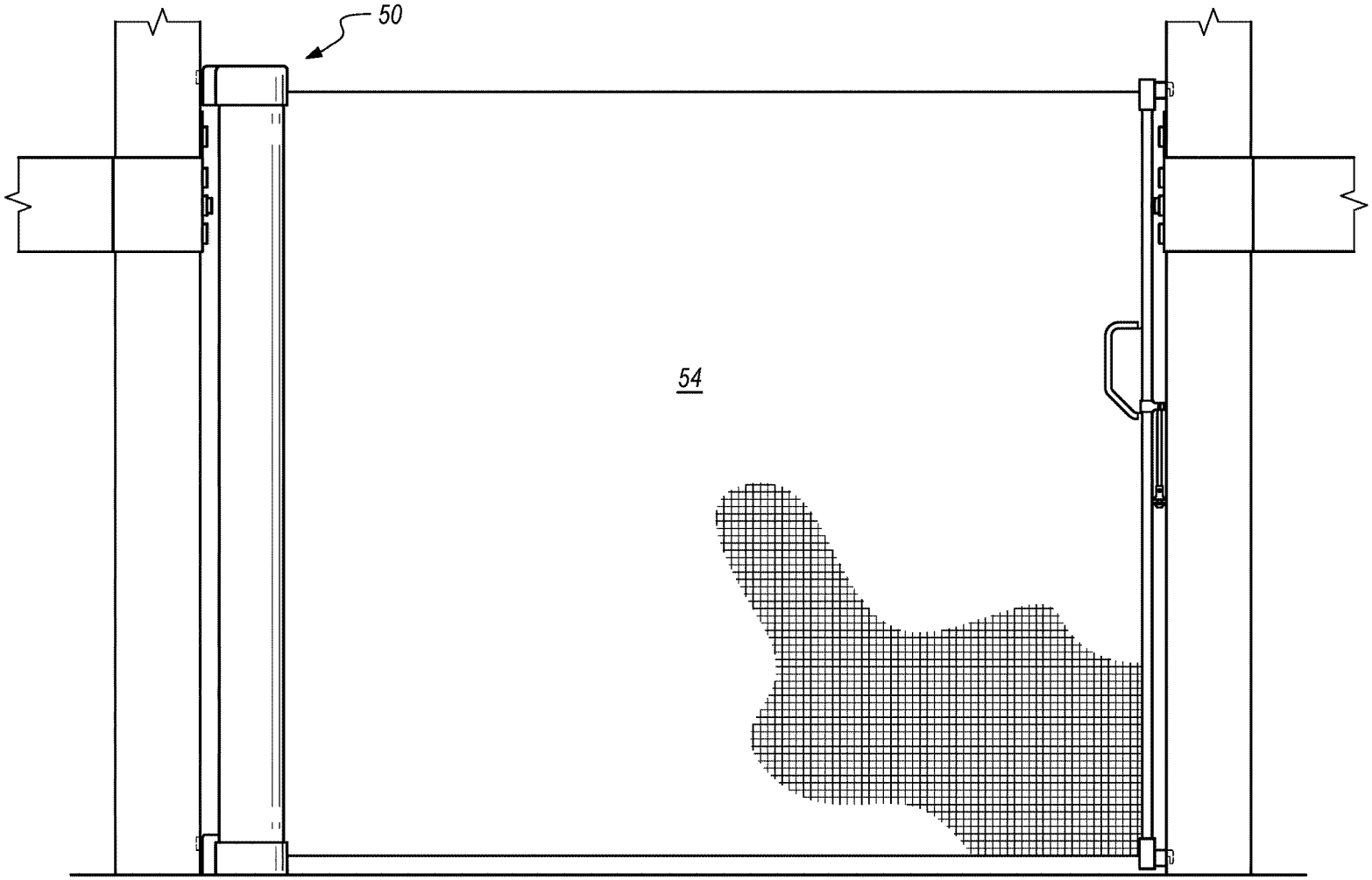
Figure 26:
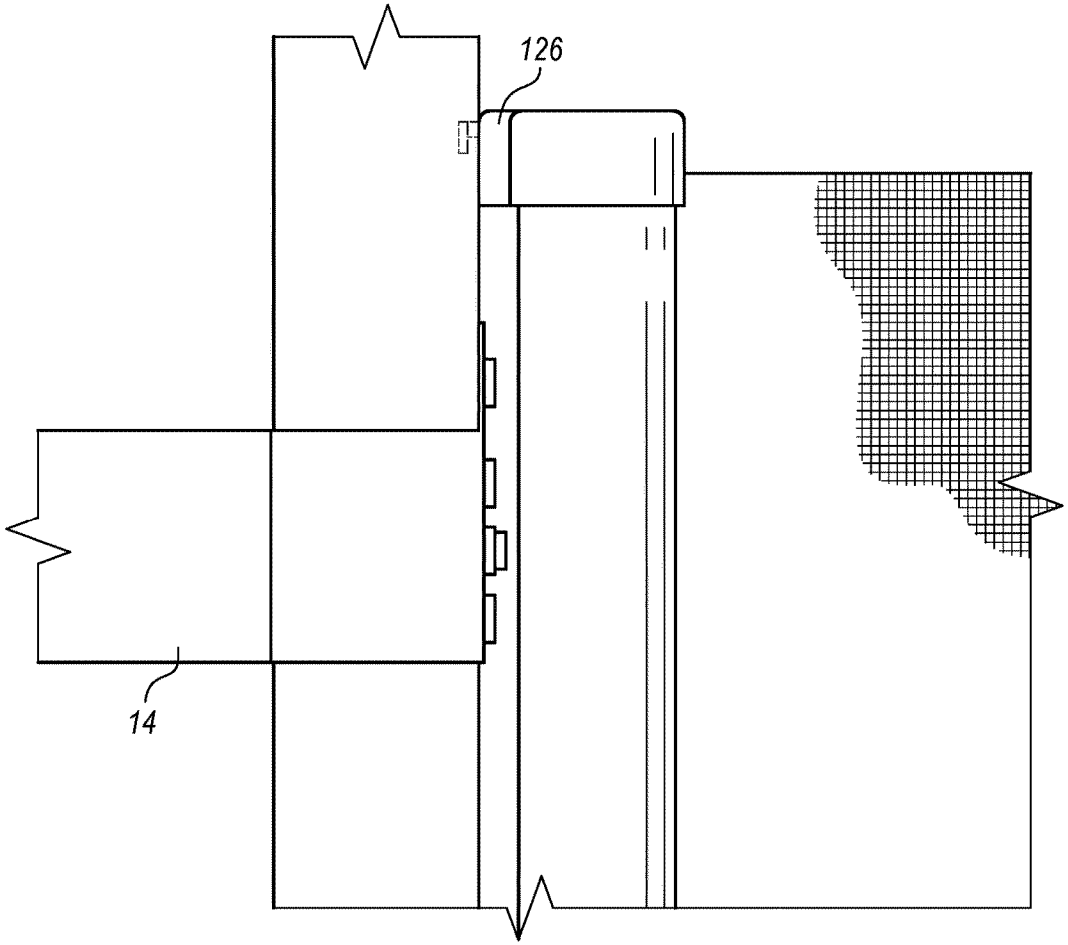

Referring to FIGS. 24-26, the standoff portions 48 and attachment mechanisms 50 function to provide "bridging" at the trailing gate end 56 over intervening objects such as the above referenced rack beams 14 and fasteners 26, as well as displayed product and machinery. As referenced above, standoff portions 126 and hook brackets 110 (with or without adjustment means 128) further permit attachment to the aforementioned pallet rack assembly posts 12 (including outward facing post sections 16 and side post sections 18) in the event one or more keyhole slots 24*a* in a given vertical row are occupied leaving the corresponding horizontal pair 24*b* available. Although shown and described as single piece top and bottom caps 98 and 100, each respective may comprise multiple pieces. For example, each cap may be a two-piece cap affixed to one another by screws or other suitable fastening means.

Figure 27:
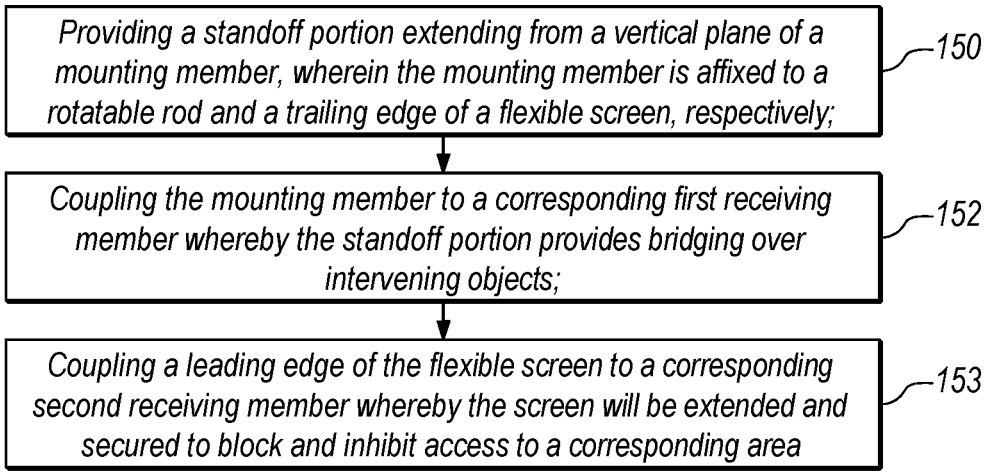
FIG. 27 is a flow diagram of representative method steps of the present invention.

In keeping with the invention, there is further provided a method for inhibiting access to retail and warehouse aisles and the like as shown in the flow diagram of FIG. 27. The method comprises providing 150 a standoff portion extending from a vertical plane of a mounting member, wherein the mounting member is affixed to a rotatable rod and a trailing edge of a flexible screen, respectively. The method further comprises coupling 152 the mounting member to a corresponding first receiving member whereby the standoff portion provides bridging over intervening objects. Lastly, the method comprises coupling 154 a leading edge of the flexible screen to a corresponding second receiving member whereby the screen will be extended and secured to inhibit access to a corresponding area.

While embodiments of the invention have been illustrated and described, it is not intended that these embodiments illustrate and describe all possible forms of the invention. Rather, the words used in the specification are words of description rather than limitation, and it is understood that various changes may be made and equivalent structures, features and functions may be provided without departing from the spirit and scope of the invention.

What is claimed is:

1. A retractable barrier system for temporary installation by a user to inhibit access to retail and warehouse aisles defined by opposing first and second posts of a corresponding shelving assembly positioned on a floor, each post having an outwardly facing section and including a plurality of vertically spaced apertures, the system comprising:

a rotatable rod having a first attachment mechanism for selectively coupling and decoupling with a first aperture selected from the plurality of vertically spaced apertures of the outwardly facing section of the first post;

a flexible screen having a leading edge, a trailing edge, and a top edge extending between the leading and the trailing edge, the trailing edge coupled to the rotatable rod;

a bar arm having a first end affixed to the leading edge of the flexible screen and a second end having a bar arm hook for selectively coupling and decoupling with a second aperture selected from the plurality of vertically spaced apertures of the outwardly facing section of the second end post, wherein the bar arm is rotatable at its first end in (a) a vertical plane about the leading edge of the flexible screen, and (b) a horizontal plane about the leading edge of the flexible screen, to orient the bar arm at selected angles within the respective vertical and horizontal planes to create a gap between the leading edge and the second aperture spanning over an object stored in proximity to the leading edge to avoid contact of the leading edge with the object; and a winding mechanism coupled to the rotatable rod for retractably receiving and extending the flexible screen, wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with objects stored in proximity to the corresponding posts, the foregoing permitting the retractable barrier system to be temporarily installed in a variety of different positions in the retail and warehouse aisles and readily removed following the completion of each use.

2. The retractable barrier system of claim 1, wherein the first attachment mechanism comprises a standoff portion extending therefrom substantially perpendicular to an axis of rotation of the rotatable rod and having a stand off hook for selectively coupling and decoupling with a first aperture selected from the plurality of vertically spaced apertures of the outwardly facing section of the first post to create a gap between the rotatable rod and the first aperture spanning over an object stored in proximity to the rotatable rod to avoid contact of the rotatable rod with the object.

3. The retractable barrier system of claim 1, wherein the winding mechanism comprises a spring mechanism for applying rotational tension on the rotatable rod.

4. The retractable barrier system of claim 3, wherein the spring mechanism comprises a torsion spring.

5. The retractable barrier system of claim 1, wherein the flexible screen includes printing on at least one side.

6. A retractable barrier system for temporary installation by a user to inhibit access to retail and warehouse aisles defined by opposing first and second posts of a corresponding shelving assembly positioned on a floor, each post having an outwardly facing section and including a plurality of vertically spaced apertures, the system, comprising:

a rotatable rod having a standoff portion extending therefrom substantially perpendicular to an axis of rotation of the rotatable rod and having a stand off hook for selectively coupling and decoupling with a first aperture selected from the plurality of vertically spaced apertures of the outwardly facing section of the first post to create a gap between the rotatable rod and the first aperture spanning over an object stored in proximity to the rotatable rod to avoid contact of the rotatable rod with the object;

a flexible screen having a leading edge, a trailing edge, and a top edge extending between the leading edge and the trailing edge, the trailing edge coupled to the rotatable rod, and the leading edge having a second attachment mechanism for selectively coupling and decoupling with a second aperture selected from the plurality of vertically spaced apertures of the outwardly facing section of the second post; and a winding mechanism coupled to the rotatable rod for retractably receiving and extending the flexible screen, wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with one or more objects stored in proximity to the corresponding end posts, the foregoing permitting the retractable barrier system to be temporarily installed in a variety of different positions in the retail and warehouse aisles and readily removed following the completion of each use.

7. The retractable barrier system of claim 6, wherein the winding mechanism comprises a spring mechanism for applying rotational tension on the rotatable rod.

8. The retractable barrier system of claim 7, wherein the spring mechanism comprises a torsion spring.

9. A retractable barrier system for temporary installation by a user to inhibit access to retail and warehouse aisles defined by opposing first and second posts of a corresponding shelving assembly positioned on a floor, each post having an outwardly facing section and including a plurality of vertically spaced apertures, the system, comprising:

a housing having a first end and a second end, a mounting side wall, and at least a supplemental sidewall having an elongate opening, the mounting sidewall and supplemental sidewall extending between the first and second housing ends;

a rotatable rod disposed within the housing and coupled thereto;

at least one end cap affixed to the housing and having a standoff portion extending therefrom substantially perpendicular to an axis of rotation of the rotatable rod and having a stand off hook for selectively coupling and decoupling with a first aperture selected from the plurality of vertically spaced apertures of the outwardly facing section of the first post to create a gap between the housing and the first aperture spanning over an object stored in proximity to the housing to avoid contact of the housing with the object;

a flexible screen having a leading edge, a trailing edge, and a top edge extending between the leading edge and trailing edge, the trailing edge coupled to the rotatable rod, and the leading edge having an edge attachment mechanism for selectively coupling and decoupling with a second aperture selected from the plurality of vertically spaced apertures of the outwardly facing section of the second post; and a winding mechanism coupled to the rotatable rod for retractably receiving and extending the flexible screen through the elongate opening of the supplemental sidewall;

wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with objects stored in proximity to the corresponding end posts, the foregoing permitting the retractable barrier system to be temporarily installed in a variety of different positions in the retail and warehouse aisles and readily removed following the completion of each use.

10. The retractable barrier system of claim 9, wherein the winding mechanism comprises a spring mechanism for applying rotational tension on the rotatable rod.

11. The retractable barrier system of claim 10, wherein the spring mechanism comprises a torsion spring.

12. A method for a user to temporarily inhibit access to retail and warehouse aisles defined by opposing first and second posts of a corresponding shelving assembly positioned on a floor, each post having an outwardly facing section and including a plurality of vertically spaced apertures, the method comprising:

providing a rotatable rod having a standoff portion extending therefrom substantially perpendicular to an axis of rotation of the rotatable rod and having a stand off hook, the rotatable rod coupled to a flexible and retractable screen having a leading edge, a trailing edge, and a top edge extending between the leading edge and the trailing edge, and a winding mechanism;

applying rotational tension to the rotatable rod through the winding mechanism; and selecting a first aperture from the plurality of vertically spaced apertures of the outwardly facing section of the first post to (a) adjust a installed height of the flexible screen as measured between the floor and the corresponding top edge of the trailing edge, and (b) to avoid contact with an object stored in proximity to the first end post; and selectively coupling the standoff off hook with the selected first aperture to create a gap between the rotatable rod and the first aperture spanning over an object stored in proximity to the rotatable rod to avoid contact of the rotatable rod with the object;

wherein the retractable barrier system may be temporarily installed in a variety of different positions in the retail and warehouse aisles and readily removed following completion of each use.

* * * * *